US010792724B2

(12) United States Patent
Ishihara et al.

(10) Patent No.: US 10,792,724 B2
(45) Date of Patent: Oct. 6, 2020

(54) COILED MATERIAL TRANSPORTING DEVICE, PRESS SYSTEM AND COILED MATERIAL TRANSPORTING METHOD

(71) Applicant: KOMATSU INDUSTRIES CORPORATION, Kanazawa-shi, Ishikawa (JP)

(72) Inventors: Makoto Ishihara, Komatsu (JP); Ikuhiro Hirotani, Komatsu (JP); Hidekazu Tokunaga, Komatsu (JP)

(73) Assignee: KOMATSU INDUSTRIES CORPORATION, Ishikawa (JP)

( * ) Notice: Subject to any disclaimer, the term of this patent is extended or adjusted under 35 U.S.C. 154(b) by 426 days.

(21) Appl. No.: 15/739,439

(22) PCT Filed: Aug. 15, 2016

(86) PCT No.: PCT/JP2016/073840
§ 371 (c)(1),
(2) Date: Dec. 22, 2017

(87) PCT Pub. No.: WO2017/038440
PCT Pub. Date: Mar. 9, 2017

(65) Prior Publication Data

US 2018/0169733 A1 Jun. 21, 2018

(30) Foreign Application Priority Data

Aug. 28, 2015 (JP) ..... 2015-168626

(51) Int. Cl.
*B21C 47/24* (2006.01)
*B21C 47/10* (2006.01)
(Continued)

(52) U.S. Cl.
CPC ..... *B21D 43/09* (2013.01); *B21C 47/10* (2013.01); *B21C 47/16* (2013.01); *B21C 47/24* (2013.01);
(Continued)

(58) Field of Classification Search
CPC ..... B30B 15/30; B30B 15/302; B30B 15/304; B30B 15/306; B21C 47/10; B21C 47/12;
(Continued)

(56) References Cited

U.S. PATENT DOCUMENTS 3,686,921 A * 8/1972 Roper ..... B21C 47/16 72/302
3,974,920 A * 8/1976 Bumann ..... B21D 43/003 414/677
4,464,916 A * 8/1984 Grew ..... B65H 23/192 226/44
4,577,486 A * 3/1986 Baba ..... B21D 43/13 414/751.1
(Continued)

FOREIGN PATENT DOCUMENTS

CN 2785754 Y 6/2006
CN 201366451 Y 12/2009
(Continued)

OTHER PUBLICATIONS

The Office Action for the corresponding Japanese application No. 2015-168626, dated Jun. 18, 2019.
(Continued)

*Primary Examiner* — Jimmy T Nguyen
(74) *Attorney, Agent, or Firm* — Global IP Counselors, LLP

(57) ABSTRACT

A coiled material transporting device is disposed between a coiled material supply device supplying a coiled material, and a press device pressing the coiled material supplied from
(Continued)

the coiled material supply device. The coiled material supply device includes a support, a first driver, and a transporter. The support is extendable and retractable along a direction of a die disposed in the press device. The support is configured to support from below a terminal end of the coiled material supplied from the coiled material supply device. The first driver is configured to cause the support to extend and retract. The transporter is provided to the support and is configured to transport the terminal end of the coiled material toward the die disposed in the press device.

11 Claims, 18 Drawing Sheets

(51) Int. Cl.

| | |
|---|---|
| ***B21C 47/16*** | (2006.01) |
| ***B21D 43/09*** | (2006.01) |
| ***B21D 43/02*** | (2006.01) |
| ***B21D 43/04*** | (2006.01) |
| ***B30B 15/30*** | (2006.01) |

(52) U.S. Cl.
CPC ..... *B21D 43/02* (2013.01); *B21D 43/04* (2013.01); *B30B 15/30* (2013.01)

(58) Field of Classification Search
CPC ..... B21C 47/16; B21C 47/24; B21D 43/02; B21D 43/04; B21D 43/09; B21D 43/13; B65H 20/02; B65H 20/04; B65H 20/06; B65H 23/1888; B65H 23/192; B21B 37/52; B21B 37/50; B21B 37/48
USPC ..... 72/8.6, 11.4, 12.3
See application file for complete search history.

(56) References Cited

U.S. PATENT DOCUMENTS

| | | | | |
|---|---|---|---|---|
| 2004/0079780 | A1* | 4/2004 | Kato | B21D 43/022 226/24 |
| 2015/0128422 | A1* | 5/2015 | Rasmussen | B21D 35/00 29/897.32 |

FOREIGN PATENT DOCUMENTS

| | | | | | |
|---|---|---|---|---|---|
| CN | 203556637 | U | | 4/2014 | |
| CN | 103894506 | A | | 7/2014 | |
| CN | 204584090 | U | | 8/2015 | |
| DE | 3718867 | C1 | * | 7/1988 | B21C 47/10 |
| EP | 1424148 | A1 | * | 6/2004 | B21D 43/021 |
| EP | 2562108 | A2 | * | 2/2013 | H01F 41/0233 |
| JP | 58-205629 | A | | 11/1983 | |
| JP | 58-56018 | Y2 | | 12/1983 | |
| JP | 50-42621 | U | | 3/1985 | |
| JP | 2-48223 | U | | 4/1990 | |
| JP | 6-9728 | U | | 2/1994 | |
| JP | 7-35619 | Y2 | | 8/1995 | |
| JP | 11-244968 | A | | 9/1999 | |
| JP | 2003-154423 | A | | 5/2003 | |
| JP | 2005-334940 | A | | 12/2005 | |
| JP | 2007-7713 | A | | 1/2007 | |
| JP | 2017154154 | A | * | 9/2017 | B21B 37/68 |

OTHER PUBLICATIONS

The International Search Report for the corresponding international application No. PCT/JP2016/073840, dated Nov. 8, 2016.
The Office Action for the corresponding Japanese application No. 2015-168626, dated Jan. 7, 2020.
The Office Action for the corresponding Chinese application No. 201680034852.X, dated Nov. 1, 2018.

* cited by examiner

COILED MATERIAL TRANSPORTING DEVICE, PRESS SYSTEM AND COILED MATERIAL TRANSPORTING METHOD

CROSS-REFERENCE TO RELATED APPLICATIONS

This application is a U.S. National stage application of International Application No. PCT/JP2016/073840, filed on Aug. 15, 2016. This U.S. National stage application claims priority under 35 U.S.C. § 119(a) to Japanese Patent Application No. 2015-168626, filed in Japan on Aug. 28, 2015, the entire contents of which are hereby incorporated herein by reference.

BACKGROUND

Field of the Invention

The present invention relates to a coiled material transporting device, a press system, and a coiled material transporting method.

Description of the Related Art

There has been disclosed a coil system configuration comprising a press device and a coiled material supply device for supplying a coiled material to the press device while unwinding the wound material. An uncoiler, a leveler feeder, and the like are provided to the coiled material supply device. The coiled material unwound by the uncoiler is smoothed by the leveler feeder and supplied to the press device.

With a coil system having such a configuration, when the terminal end of the coiled material passes through a feeder such as the leveler feeder, any terminal end material remaining between the feeder and the inside of the press device cannot be moved in the supply direction.

In view of this, a configuration has been disclosed in which a loader device is provided for moving the terminal end material in the supply direction (see, for example, JP-A 2003-154423).

With the loader device disclosed in this patent literature, the terminal end material on a roller conveyer is pushed against the conveyor side by an air cylinder, and is sent toward a die of the press device while this state is maintained.

SUMMARY

However, although simplified in the drawings, the loader device of JP-A 2003-154423 must be equipped with a mechanism for moving the stamping member downward, as well as a mechanism for moving it to the press device side, so the mechanism becomes larger and cannot be disposed on the inside of the press device.

Accordingly, with a conventional loader device, the terminal end of the coiled material leading to the die disposed on the inside of the press device could not be supplied from the loader device disposed on the outside of the press device to the die.

In consideration of the problems encountered with the conventional device above, it is an object of the present invention to provide a coiled material transporting device, a press system, and a coiled material transporting method with which materials can be utilized more effectively.

The coiled material transporting device pertaining to the first aspect is a coiled material transporting device that is disposed between a coiled material supply device that supplies a coiled material, and a press device that presses the coiled material supplied from the coiled material supply device, said coiled material supply device comprising a support, a first driver, and a transporter. The support is capable of extending and retracting in the direction of a die disposed in the press device, and supports from below the terminal end of the coiled material supplied from the coiled material supply device. The first driver causes the support to extend and retract. The transporter is provided to the support and transports the terminal end of the coiled material toward the die disposed in the press device.

Thus, a transporter that transports the terminal end of the coiled material is provided to the support that supports the terminal end of the coiled material from below. Accordingly, it is unnecessary to provide a mechanism for transporting the terminal end of the coiled material above the support, and the support can be extended to the inside of the press device by the first driver and disposed near the die.

Because the terminal end of the coiled material is transported by the transporter to the end of the extended support on the press device side, the terminal end of the coiled material can be fed into the die.

Since the terminal end of the coiled material can thus be fed in near the die, wasted coiled material can be kept to a minimum, and the material can be used more effectively.

The coiled material transporting device pertaining to the second aspect is the coiled material transporting device pertaining to the first aspect, further comprising a controller. This controller controls the first driver so that when the terminal end of the coiled material is transported to the die disposed in the press device, a first end on the press device side of the support will be disposed at a position corresponding to the die disposed in the press device.

Since the user will use dies of various sizes and shapes, it is common to use a bolster whose size matches the size of the largest die to be used. Accordingly, when a small die is used, for example, the die is disposed at a position that is more to the inside than the outer edge of the bolster, so material ends up being wasted with a conventional device.

However, by setting the position of the end of the support on the press device side to match the die, even if the die is disposed to the inside of the bolster, the support can be extended to match that die. Therefore, wasted material can be reduced, and the material can be used more effectively.

The coiled material transporting device pertaining to the third aspect is the coiled material transporting device pertaining to the second aspect, further comprising a second driver. This second driver moves the end on the press device side of the support in the up and down direction. The controller controls the second driver so that the position of the first end of the support in the up and down direction will be a position corresponding to the die disposed in the press device.

Controlling the vertical position of the end of the support on the press device side in this way allows the end of the support to match the height of the die disposed in the press device. Consequently, the terminal end of the coiled material can be moved to match dies of various heights.

The coiled material transporting device pertaining to the fourth aspect is the coiled material transporting device pertaining to the third aspect, wherein the support is able to move between a supporting position at which it supports the terminal end of the coiled material from below, and a retracted position at which it has been retracted from the supporting position. The controller controls the first driver and the second driver so that the support is moved between the supporting position and the retracted position.

The coiled material guided to the die disposed in the press device is disposed in the lifter guide of the die, and during pressing, the lifter guide sinks down and the coiled material also moves downward. Therefore, in a state in which the support is disposed at the supporting position during pressing, the pressing of the coiled material may be affected.

However, with the above invention, since the support is able to move between the supporting position and the retracted position, the support is moved to the retracted position during pressing, and after the terminal end of the coiled material comes out of the feeder, the support is moved to the supporting position and the terminal end is transported. This prevents the support from affecting the coiled material pressing.

The coiled material transporting device pertaining to the fifth aspect is the coiled material transporting device pertaining to the fourth aspect, further comprising a storage component. The storage component stores the support position for each die disposed in the press device. The controller controls the first driver and the second driver so that the support is disposed in the supporting position corresponding to the die disposed in the press device.

Determining the position of the support for each die by teaching or the like in advance and storing the result in the storage component allows the support to be moved automatically to the supporting position corresponding to the die disposed in the press device.

This allows the support to be positioned at the supporting position that matches each die.

The teaching may be carried out test presses with a die.

The coiled material transporting device pertaining to the sixth aspect is the coiled material transporting device pertaining to the third aspect, wherein the support is supported in the coiled material supply device so that a second end on the opposite side from the first end is able to rotate. The second driver rotates the support so that the first end moves in the up and down direction around the second end.

This rotates the support and allows the position of the end on the press device side to be located near the die disposed in the press device.

The coiled material transporting device pertaining to the seventh aspect is the coiled material transporting device pertaining to the first aspect, wherein the transporter has a contact component and a third driver. The contact component comes into contact with the terminal end of the coiled material. The third driver moves the contact component in the transport direction.

Consequently, the contact component pushes the terminal end of the coiled material in the transport direction, and the terminal end of the coiled material is transported to the die disposed in the press device.

The coiled material transporting device pertaining to the eighth aspect is the coiled material transporting device pertaining to the seventh aspect, wherein the third driver has a belt-shaped member and a drive motor. The belt-shaped member is supported by the support rotatably along the transport direction, and the contact component is fixed thereto. The drive motor rotates the belt-shaped member.

As a result, the contact component is moved in the transport direction by the rotation of the belt-shaped member.

The coiled material transporting device pertaining to the ninth aspect is the coiled material transporting device pertaining to the eighth aspect, wherein the belt-shaped member is disposed in the center of the support in the width direction perpendicular to the transport direction.

Consequently, since the contact component moves in the transport direction through the center in the width direction, the terminal end of the coiled material can be transported regardless of the width of the coiled material.

The coiled material transporting device pertaining to the tenth aspect is the coiled material transporting device pertaining to the sixth aspect, wherein the support section has a rotation component and a slider. The rotation component has the second end. The slider has the first end and is able to slide in the transport direction with respect to the rotation component. The first driver extends and retracts the support by sliding the slider with respect to the rotation component. The rotation component has a plurality of first support portions having a plurality of sliding members that are disposed along the transport direction and that allow the coiled material to slide. The slider has a plurality of second support portions having a plurality of sliding members that are disposed in the transport direction and that allow the coiled material to slider. The first support portions and the second support portions are disposed alternately from the center in the width direction of the support that is perpendicular to the transport direction, toward the ends in the width direction.

Thus employing a configuration in which the support is able to extend by means of a plurality of support portions allows a space to be formed in the center, and makes it easier to dispose the belt-shaped member.

The coiled material transporting device pertaining to the eleventh aspect is the coiled material transporting device pertaining to the second aspect, wherein the controller controls the first driver so that when the distal end of the coiled material is supplied from the coiled material supply device to the press device, the first end on the press device side of the support is disposed in a position corresponding to the die disposed in the press device.

Consequently, not only can the terminal end of the coiled material be transported toward the press device, but also the distal end of the coiled material supplied from the coiled material supply device can be guided to the press device.

Since the distal end of the coiled material can thus be guided automatically, it is unnecessary for an operator to transfer the distal end of the coiled material from the coiled material supply device to the die disposed in the press device, nor is it necessary for the operator to go into the press device every time the coiled material or the die is replaced, so setup during replacement takes less time.

The press system pertaining to the twelfth aspect comprises a coiled material supplying device main body, a press device main body, a coiled material transporting device main body, a supply device controller, a press device controller, and a transporting device controller. The coiled material supply device main body supplies the coiled material. The press device main body presses the coiled material supplied from the coiled material supply device main body. The coiled material transporting device main body is disposed between the coiled material supply device main body and the press device main body. The supply device controller controls the coiled material supply device main body. The press device controller controls the press device main body. The transporting device controller controls the coiled material transporting device main body. The coiled material transporting device main body has a support, a first driver, and a transporter. The support can extend and retract in the direction of the die disposed in the press device, and supports from below the terminal end of the coiled material supplied from the coiled material supply device main body. The first driver extends and retracts the support. The transporter is provided to the support and transports the terminal end of the coiled material toward the die disposed in the press device main body. The transport device controller controls the first driver so that when the terminal end of the coiled material is transported to the die disposed in the press device, the first end of the support on the press device main body side will be disposed at a position corresponding to the die disposed in the press device main body.

Consequently, the support can be extended to the inside of the press device main body and can be disposed near the die, and since the terminal end of the coiled material can be transported to the first end of the extended support by the transporter, the terminal end of the coiled material can be fed in up to near the die. Accordingly, wasted coiled material can be kept to a minimum, and the material can be used more effectively.

The coiled material transporting method pertaining to the thirteenth aspect comprises a die information acquisition step, a position data acquisition step, a drive step, and a transport step. The die information acquisition step involves acquiring die information about the die installed in the press device. The position data acquisition step involves acquiring position data about the die-side distal end of the support that supports the distal end of the coiled material and guides it to the die, on the basis of the die information. The drive step involves driving the support on the basis of the position data. The transport step involves transporting the terminal end of the coiled material toward the die disposed in the press device.

This allows the terminal end of the coiled material to be transported to the die. Accordingly, wasted coiled material can be kept to a minimum, and the material can be used more effectively.

The present invention provides a coiled material transporting device, a press system, and a coiled material transporting method with which materials can be utilized more effectively.

DETAILED DESCRIPTION OF EMBODIMENT(S)

The press system in an embodiment of the present invention will now be described through reference to the drawings.

1. Configuration

1-1. Overview of Press System Configuration

Figure 1:
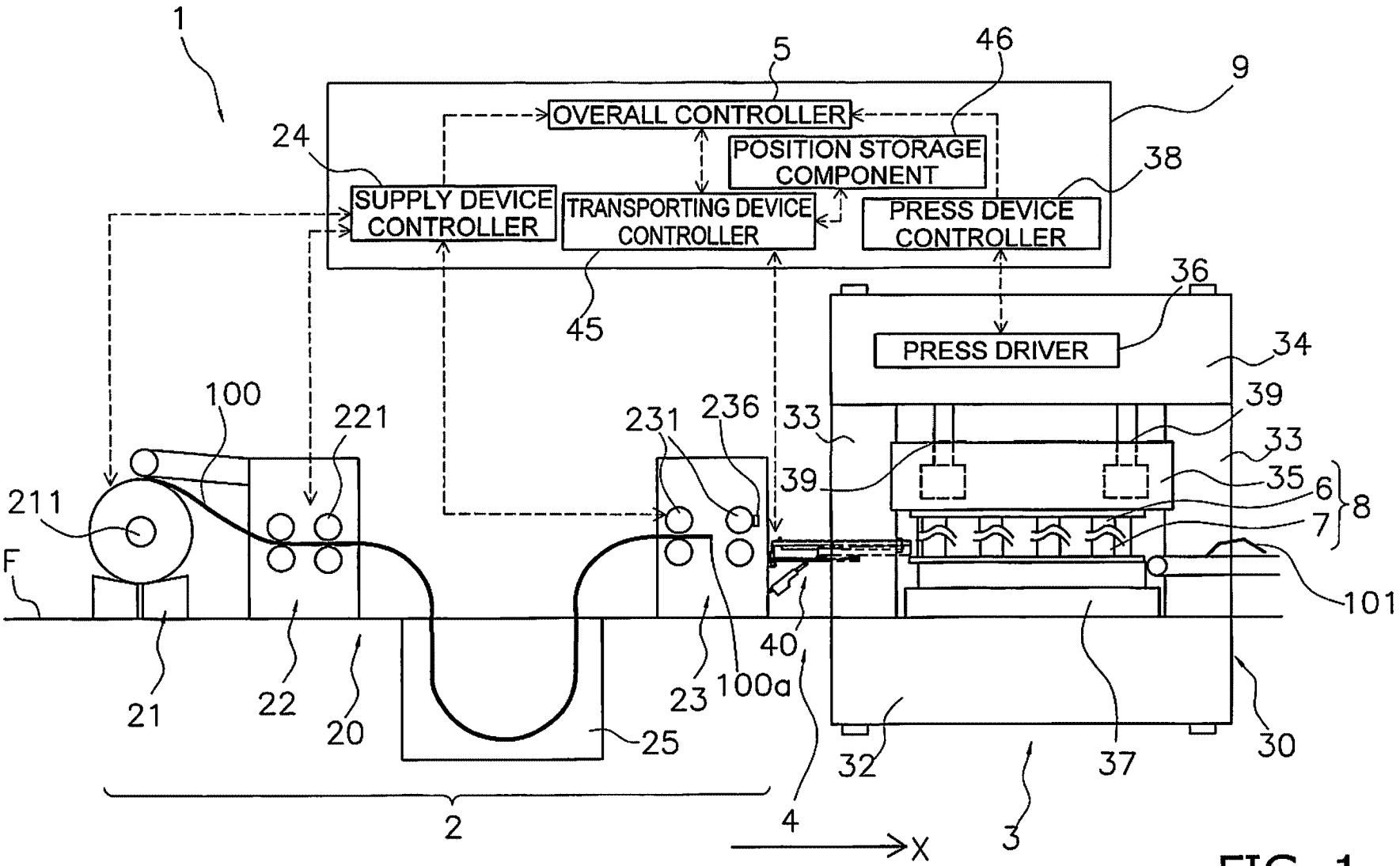
FIG. 1 shows the configuration of the press system of the present invention.

FIG. 1 is a simplified diagram of the configuration of the press system 1 in this embodiment. The press system 1 in this embodiment is a forward feed type, and comprises a coiled material supply device 2, a press device 3, a coiled material transporting device 4, and an overall controller 5.

The coiled material supply device 2 supplies a coiled material 100 to the press device 3. The press device 3 presses the coiled material 100 to form a product 101. The coiled material transporting device 4 performs guidance of the distal end 100*a* of the coiled material 100 to the press device 3, and transport of the terminal end 100*b* (see FIG. 17A) of the coiled material 100 to the press device 3.

Guiding the distal end 100*a* of the coiled material 100 to the press device 3 refers to automatically guiding the distal end 100*a* of the coiled material 100 to the press device 3 when the coiled material 100 or the die 8 is replaced. Transporting the terminal end 100*b* of the coiled material 100 to the press device 3 means that the terminal end 100*b* of the coiled material 100 is discharged from the coiled material supply device 2, and any terminal end material that could not be supplied to the press device 3 is transported to the press device 3.

The overall controller 5 controls the entire press system 1 while transmitting and receiving signals to and from a supply device controller 24 of the coiled material supply device 2, a press device controller 38 of the press device 3, and a transporting device controller 45 of the coiled material transport device 4.

The overall controller 5, the supply device controller 24, the press device controller 38, the transporting device controller 45, and a position storage component 46 (discussed below) are provided to a control device 9. The control device 9 has a CPU, a memory, a display, and an input component (keyboard, buttons, etc.).

As shown in FIG. 1, the die 8 includes an upper die 6 and a lower die 7.

1-2. Coiled Material Supply Device

The coiled material supply device 2 has a coiled material supply device main body 20 and the supply device controller 24 that controls the coiled material supply device main body 20. The coiled material supply device main body 20 has an uncoiler 21, a leveler 22, and a feeder 23.

The uncoiler 21 unwinds and feeds out the wound coiled material 100. The uncoiler 21 has a mandrel 211. The mandrel 211 has a drive mechanism and feeds out the coiled material 100.

The leveler 22 has a plurality of rollers 221, and straightens out any winding wrinkles of in coiled material 100 before it passes through the rollers 231 of the feeder 23.

The feeder 23 is disposed on the downstream side of the leveler 22 with reference to the transport direction X of the coiled material 100. The feeder 23 has a plurality of rollers 231, and transports the coiled material 100 fed out from the uncoiler 21 and straightened by the leveler 22 to the press device 3. Also, a terminal end detector 236 that detects the terminal end 100*b* (see FIG. 17A) of the coiled material 100 is provided on the downstream side of the rollers 231 of the feeder 23. The terminal end detector 236 is constituted by an optical sensor or the like, for example, and detects that the coiled material 100 has run out.

A recessed loop pit 25 is formed in the floor F between the leveler 22 and the feeder 23, and the coiled material 100 forms a loop therein. This loop eliminates the influence of intermittent feed from the feeder 23 and allows the leveler 22 to operate continuously.

The supply device controller 24 controls the drive of the uncoiler 21 and the rollers 221 and 231, and controls supply of the coiled material 100.

1-3. Pressing Device

The press device 3 is disposed on the downstream side of the feeder 23 of the coiled material supply device 2, and has a press device main body 30 and a press device controller 38 for controlling the press device main body 30.

The press device main body 30 has a bed 32, uprights 33, a crown 34, a slide 35, a pressing driver 36, and a bolster 37.

The bed 32 constitutes the base of the press device 3.

The uprights 33 are columnar members, and four of them are disposed on the bed 32.

The four uprights 33 are disposed so as to form rectangular apexes in plan view. In FIG. 1, only two uprights 33 are shown.

The crown 34 is supported above by the four uprights 33. The slide 35 is suspended below the crown 34.

The pressing driver 36 is provided to the crown 34. The pressing driver 36 is linked to the slide 35 suspended below the crown 34 via point assemblies 39, and moves the slide 35 up and down. Two of the point assemblies 39 are provided in the transport direction X, and the slide 35 is supported at two points. The number of point assemblies 39 may instead be one, or three or more.

The pressing driver 36 comprises, for example, a servo motor as a drive source, a reduction gear for decelerating the rotation of the servo motor, a crank mechanism, and the like.

The rotary motion of the servomotor is converted by the crank mechanism into up and down motion, the point assemblies 39 to which the crank mechanism is linked move up and down, and the slide 35 moves up and down.

The upper die 6 is attached with a die clamper (not shown) to the lower face of the slide 35 so as to be removable in the transport direction.

Figure 2:
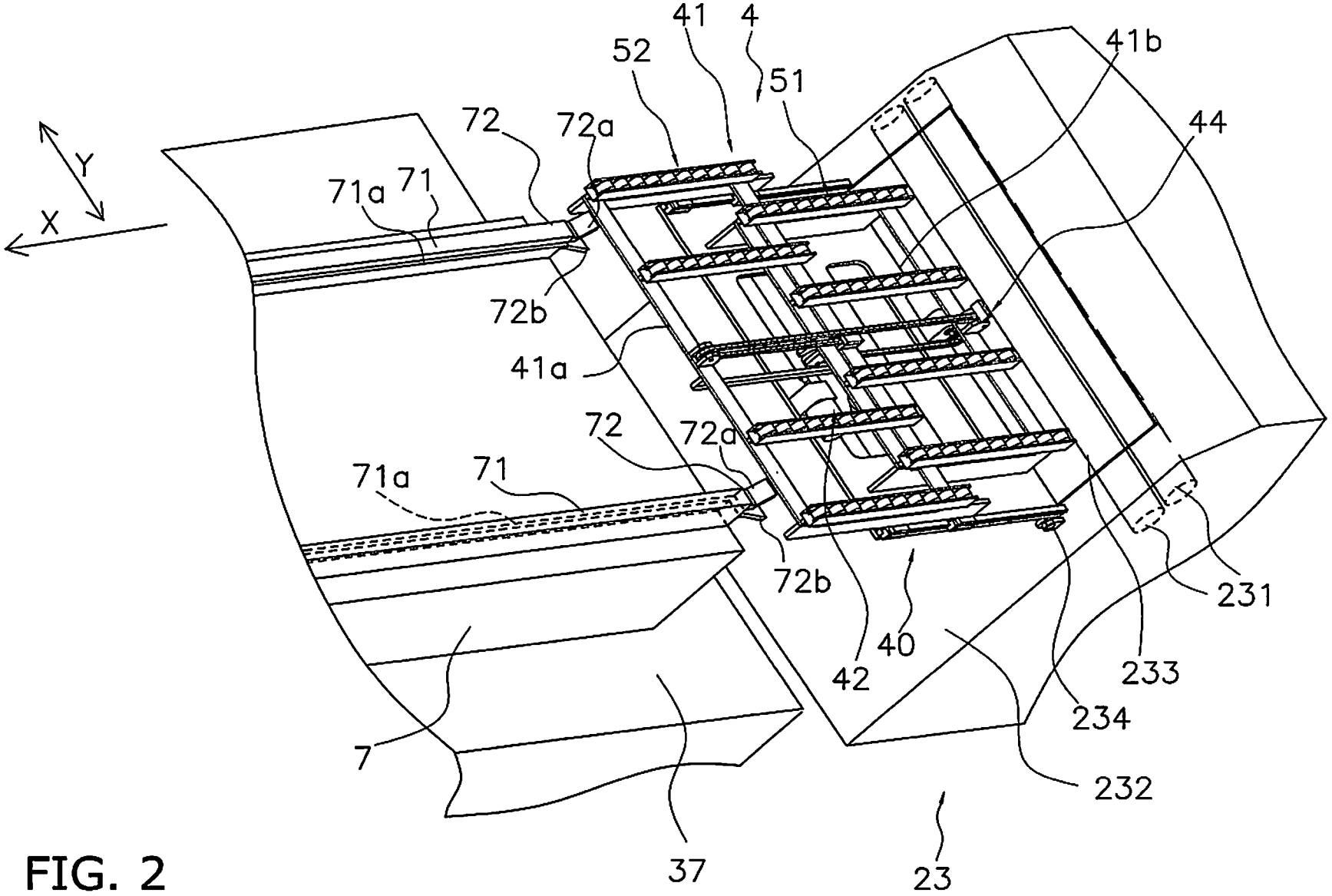
FIG. 2 is an oblique view from above, showing the area near the coiled material transporting device of the press system in FIG. 1.

The lower die 7 is placed on the bolster 37 along the transport direction. FIG. 2 is an oblique view of the configuration near the coiled material transporting device 4. In FIG. 2, only the lower die 7 of the die 8 is shown. As shown in FIG. 2, lifter guides 71 for guiding the coiled material 100 in the transport direction X are provided to the lower die 7.

The lifter guides 71 are provided at both ends in the width direction Y of the lower die 7, and grooves 71*a* are formed along the transport direction X on the inside. The two ends in the width direction Y of the coiled material 100 are fitted into the grooves 71*a* of the lifter guides 71 on both sides in the width direction Y, and consequently the coiled material 100 is guided in the transport direction X and is moved up and down during the pressing operation.

Also, end guides 72 for making it easier for the coiled material transporting device 4 to guide the distal end 100*a* of the coiled material 100 into the grooves 71*a* of the lifter guides 71 are provided at the ends of the lifter guides 71 on the coiled material supply device 2 side. The end guides 72 are made up of two guide members 72*a* and 72*b* formed toward the upstream side in the transport direction X from above and below the ends of the grooves 71*a*, and the two guide members 72*a* and 72*b* are formed so that their spacing in the up and down direction increases toward the upstream side in the transport direction X.

The press device controller 38 moves the slide 35 up and down by controlling the pressing driver 36 to match the supply of the coiled material 100 by the supply device controller 24 and the transporting device controller 45. Pressing is performed as a result.

1-4. Coiled Material Transporting Device

As shown in FIG. 1, the coiled material transporting device 4 in this embodiment comprises a coiled material transporting device main body 40, the transporting device controller 45, and the position storage component 46.

The transporting device controller 45 controls the coiled material transporting device main body 40. The position storage component 46 stores the supporting position of the support 41 (discussed below) of the coiled material transporting device main body 40 for each die 8.

Figure 3:
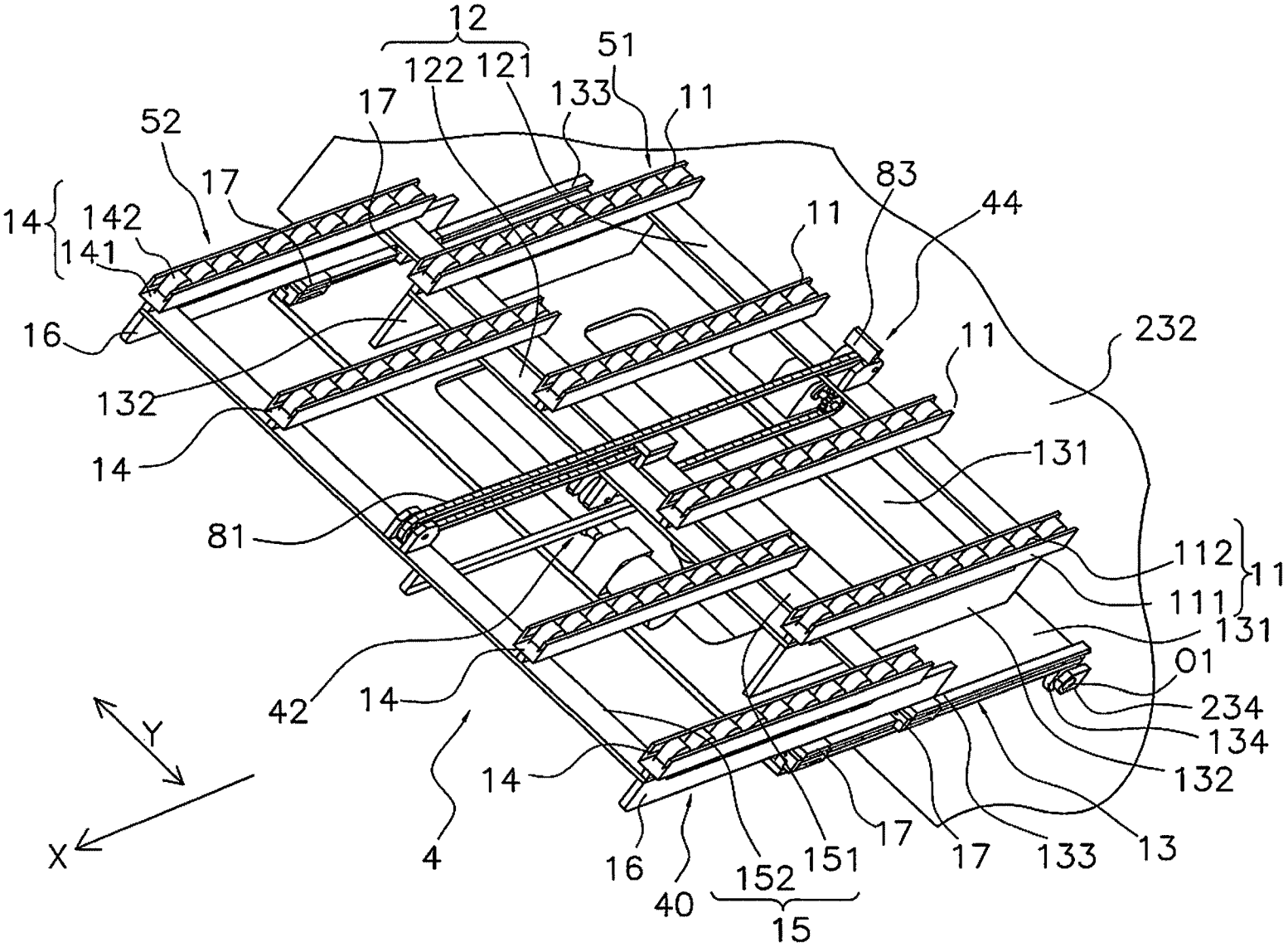
FIG. 3 is a detail oblique view of the coiled material transporting device in FIG. 2.
Figure 4:
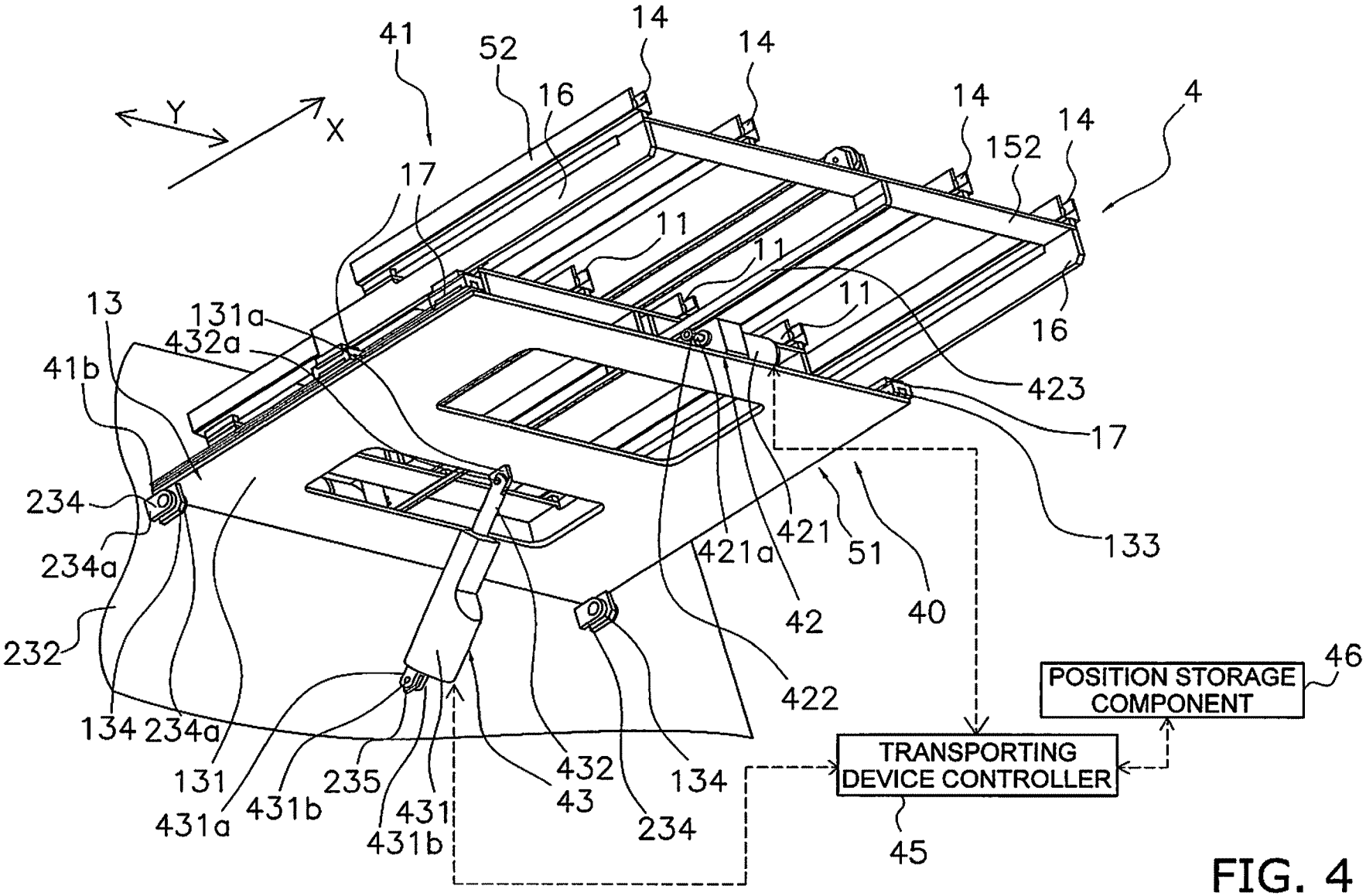
FIG. 4 is an oblique view from above, showing the coiled material transporting device in FIG. 3.

FIG. 3 is a detail view of the coiled material transporting device main body 40 in FIG. 2. FIG. 3 shows the state when the support 41 has rotated upward and a slide component 52 (discussed below) has slid to the press device 3 side with respect to a rotation component 51. FIG. 4 is an oblique view of the coiled material transporting device main body 40 in FIG. 3, as seen from below on the downstream side in the transport direction X.

As shown in FIGS. 2 to 4, the coiled material transporting device main body 40 mainly has the support 41 (see FIG. 2), a slide driver 42 (see FIGS. 2 and 4), a rotation driver 43 (see FIG. 4), and a transporter 44 (see FIGS. 2 and 3).

The support 41 supports from below the coiled material 100 supplied from the coiled material supply device 2, and thereby guides the distal end 100*a* (see FIG. 1) of the coiled material 100 to the end guides 72 of the die 8 disposed in the press device 3.

The slide driver 42 extends and retracts the support 41. The rotation driver 43 rotates the support 41 around the end 41*b* on the housing 232 side of the feeder 23.

Driving the slide driver 42 and the rotation driver 43 causes the support 41 to move between a supporting position (see FIG. 6; discussed below) and a retracted position where the support 41 is retracted from the supporting position (see FIG. 8; discussed below). The supporting position is the position at which the coiled material 100 is supported when the distal end 100*a* of the coiled material 100 is being guided and the terminal end 100*b* is being transported.

1-4-1. Support

The support 41 is rotatably provided on a side face of the housing 232 of the feeder 23. As shown in FIG. 2, a discharge port 233 for the coiled material 100 is formed on the side face of the housing 232 on the press device 3 side, and the end of the support 41 on the press device 3 side rotates around the end 41*b* on the feeder 23 side, disposed below the discharge port 233.

As shown in FIGS. 2 to 4, the support 41 has the rotation component 51 and the slide component 52.

1-4-1-1. Rotation Component

As shown in FIG. 3, the rotation component 51 mainly has four first roller units 11 disposed along the width direction Y (the direction perpendicular to the transport direction X), a connector frame 12 that connects the four first roller units 11, and a rotary frame 13.

(a) First Roller Units

As shown in FIG. 3, the first roller units 11 each have a roller support frame 111 and a plurality of rollers 112 rotatably supported on the roller support frame Ill. The roller support frame 111 is formed such that a cross section perpendicular to the transport direction X is U shaped, and is formed in the transport direction X. The rollers 112 are lined up in the transport direction X, and are rotatably supported by the roller support frame 111. Each roller 112 is axially supported by the opposing side faces of the roller support frame 111, and its axis of rotation is in the width direction Y. Four of these first roller units 11 are disposed spaced apart along the width direction Y. The number of first roller units 11 is not limited to four. However, it is preferable for two or more of them to be provided in order to support the coiled material 100 stably.

(b) Connector Frame

As shown in FIG. 3, the connector frame 12 has an upstream-side connection member 121 that connects the ends of the four first roller units 11 on the upstream side in the transport direction X, and a downstream-side connection member 122 that connects the ends of the four first roller units 11 on the downstream side in the transport direction X.

The upstream-side connection member 121 is a plate-shaped member that is longer in the width direction Y, and the upstream ends of the four first roller units 11 are fixed to the upper face thereof.

The downstream-side connection member 122 is a plate-shaped member that is longer in the width direction Y, and the downstream ends of the four first roller units 11 are fixed to the upper face thereof.

(c) Rotary Frame

As shown in FIGS. 3 and 4, the rotary frame 13 is disposed on the lower side of the connector frame 12. The connector frame 12 shown in FIG. 3 is fixed to the upper face side of the rotary frame 13.

As shown in FIG. 3, the rotary frame 13 is formed by a rotary plate-like part 131, a pair of vertical plates 132 erected on the upper face of the rotary plate-like part 131, a pair of linear rails 133, and a pair of rotation fulcrums 134.

The rotary plate-like part 131 is disposed to be substantially horizontal in the supporting position in FIG. 2. The vertical plates 132 are erected on the upper face of the rotary plate-like part 131. The pair of vertical plates 132 are disposed in the transport direction X so that their main faces are parallel to the transport direction X. The pair of vertical plates 132 are disposed aligned in the width direction Y with a specific spacing in between. The upstream-side connection member 121 and the downstream-side connection member 122 are fixed to the upper side of the vertical plates 132.

The pair of linear rails 133 are disposed at both ends in the width direction Y of the rotary plate-like part 131. The linear rails 133 constitute a linear guide together with linear boxes 17 (discussed below).

The rotation fulcrums 134 are provided to the upstream ends in the transport direction X, at both ends in the width direction Y of the rotary plate-like part 131 (the ends 41*b* of the support 41). The rotation fulcrums 134 are provided protruding downward from the lower face of the rotary plate-like part 131.

As shown in FIGS. 2 and 3, rotary supports 234 that axially support the rotary frame 13 rotatably are provided to portions of the housing 232 on both sides in the width direction Y of the discharge port 233 of the feeder 23. As shown in FIG. 3, the rotation fulcrums 134 are rotatably supported by the rotary supports 234.

More precisely, as shown in FIG. 4, the rotary supports 234 are formed from a pair of protrusions 234*a* disposed at a specific spacing, and the rotation fulcrums 134 are disposed between the protrusions 234*a*. The rotation fulcrums 134 are able to rotate with respect to the rotary supports 234 by means of a shaft and a shaft hole, etc., formed on the protrusions 234*a* and the rotation fulcrums 134. The rotational axis is indicated by O1 in FIG. 3.

1-4-1-2. Slide

As shown in FIG. 3, the slide component 52 mainly has four second roller units 14 disposed along the width direction Y (the direction perpendicular to the transport direction X), a connector frame 15 that connects the four second roller units 14, a pair of vertical plates 16, and a plurality of linear boxes 17.

(a) Second Roller Units

The second roller units 14 each have a roller support frame 141 and a plurality of rollers 142 that are rotatably supported by the roller support frame 141. The roller support frames 141 are formed such that a cross section perpendicular to the transport direction X is U shaped, and are formed longer in the transport direction X. The rollers 142 are lined up in the transport direction X, and are rotatably supported by the roller support frame 141. Each roller 142 is axially supported on the opposing side faces of the roller support frame 141, and rotates around the width direction Y. Four of these second roller units 14 are disposed spaced apart in the width direction Y. The number of the second roller units 14 is not limited to four. However, it is preferable for there to be two or more in order to support the coiled material 100 stably.

Of the four second roller units 14, the second roller units 14 on the outside in the width direction Y are disposed more to the outside than the four first roller units 11 in the width direction Y. The second roller unit 14 located second from the right facing the downstream side in the transport direction X is disposed between the first and second first roller units 11 from the right in the width direction Y. The second roller unit 14 located third from the right is disposed between the third and fourth first roller units 11 from the right in the width direction Y.

With this configuration, it can also be said that the first roller units 11 and the second roller units 14 are disposed alternately facing outward from the center in the width direction Y.

The coiled material 100 is transported above the first roller units 11 and the second roller units 14 (more precisely, above the rollers 112 and 142).

(b) Connector Frame

As shown in FIG. 3, the connector frame 15 has an upstream-side connection member 151 that connects the upstream ends of the second roller units 14 in the transport direction X, and a downstream-side connection member 152 that connects the downstream ends of the second roller units 14 in the transport direction X.

The upstream-side connection member 151 is a plate-shaped member that is longer in the width direction V. and the upstream ends of the four second roller units 14 are fixed to the upper face thereof.

The downstream-side connection member 152 is a plate-shaped member that is longer in the width direction Y, and the downstream ends of the four second roller units 14 are fixed to the upper face thereof.

Here, the upstream-side connection member 151 is disposed between the upstream-side connection member 121 and the downstream-side connection member 122 of the connector frame 12 that connects the four first roller units 11 and passes under the first roller units 11. The downstream-side connection member 152 is disposed on the downstream side of the downstream-side connection member 122.

(c) Vertical Plates

As shown in FIG. 3, the pair of vertical plates 16 are disposed along the transport direction X so that their main faces are parallel to the vertical direction, and are fixed to the lower sides of the upstream-side connection member 151 and the downstream-side connection member 152. The vertical plates 16 are disposed below the second roller units 14 disposed at both ends in the width direction Y, out of the four second roller units 14.

(d) Linear Boxes

Two of the linear boxes 17 are provided for each vertical plate 16, and the linear guide is constituted by the linear rails 133 and the linear boxes 17. The number of linear boxes 17 may be two or more for each vertical plate 16.

1-4-2. Slide Driver

As shown in FIG. 4, the slide driver 42 mainly has an electric motor 421, a pinion 422, and a rack 423.

The electric motor 421 is disposed near the center of the distal end on the press device main body 30 side of the rotary plate-like part 131 of the rotary frame 13. The electric motor 421 has a rotary shaft 421*a* disposed along the width direction Y. The electric motor 421 can be, for example, a servo motor or the like.

The pinion 422 is fixed to the rotary shaft 421*a* and rotates along with the rotary shaft 421*a*. The rack 423 is disposed along the transport direction X above the pinion 422 and near the center of the width direction Y, and meshes with the pinion 422. The rack 423 is fixed to the lower sides of the upstream-side connection member 151 and the downstream-side connection member 152 of the slide component 52 through the space between the rotary plate-like part 131 and the downstream-side connection member 122 of the rotation component 51.

The electric motor 421 is controlled by the transporting device controller 45. The pinion 422 is rotated by the rotation of the electric motor 421, and the rack 423 meshed with the pinion 422 moves in the transport direction X. This movement of the rack 423 causes the slide component 52 to which the rack 423 is fixed to slide with respect to the rotation component 51, and causes the support 41 to extend and retract.

Figure 5:
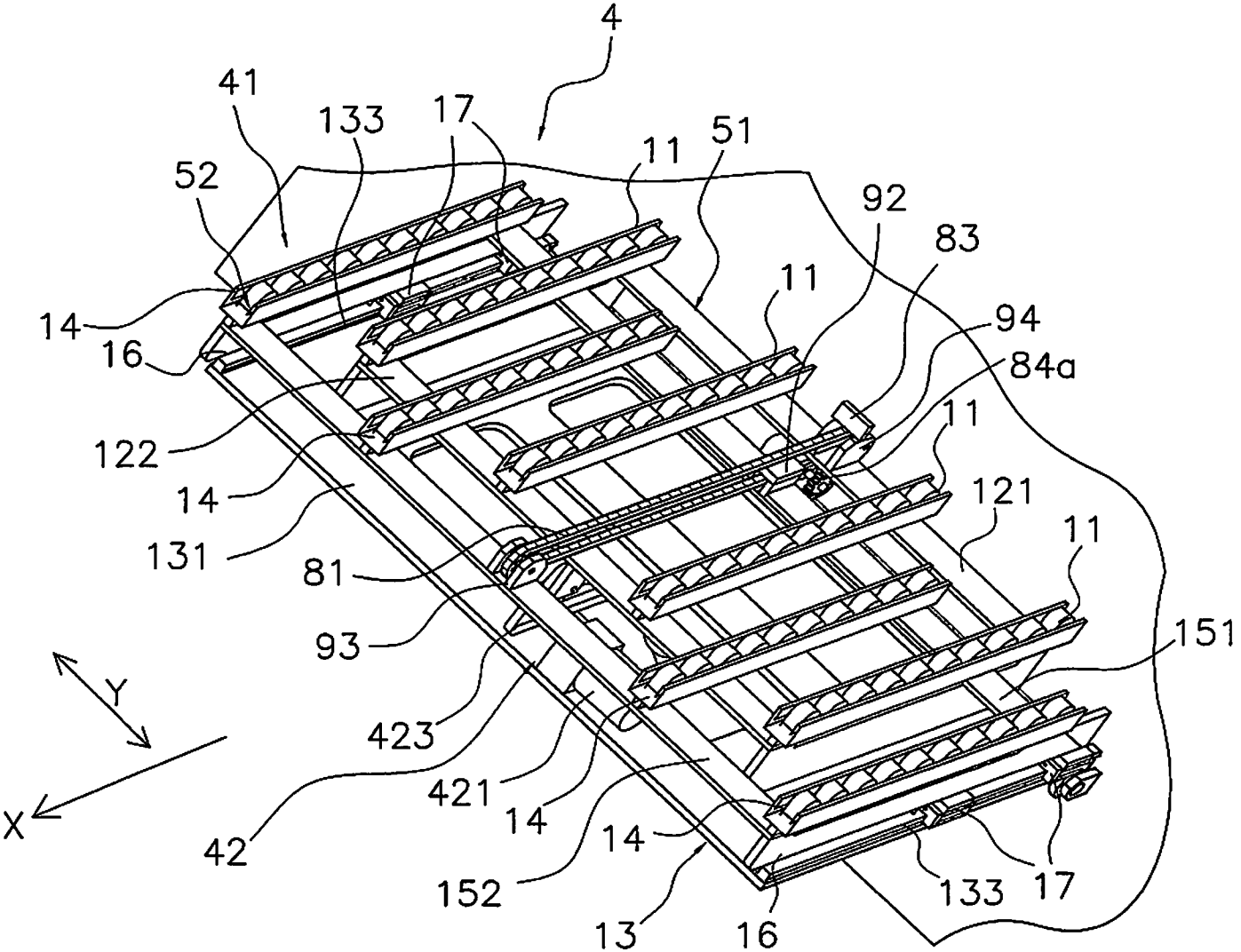
FIG. 5 is an oblique view of the state when the support of the coiled material transporting device in FIG. 3 is contracted.
Figure 6:
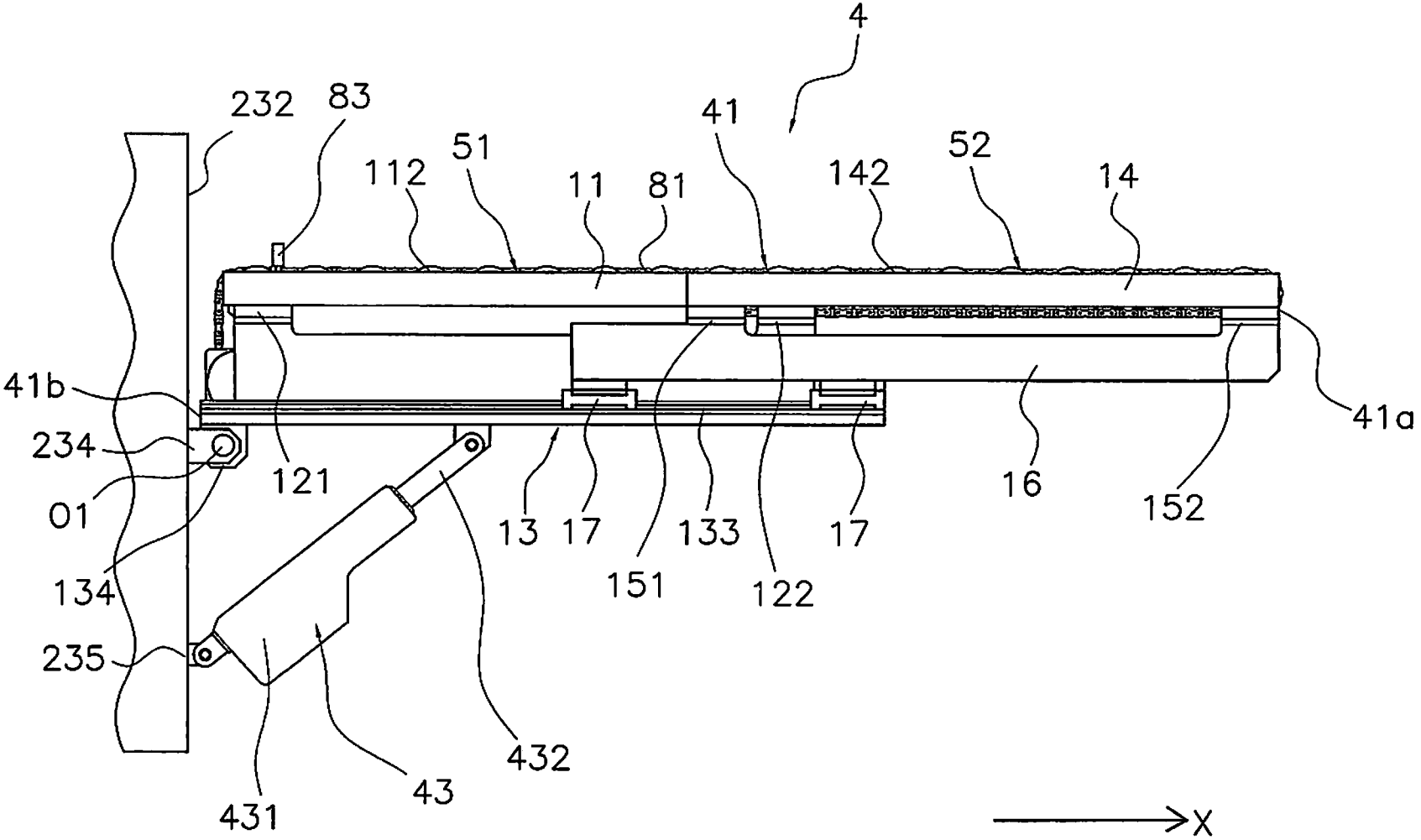
FIG. 6 is a side view of the coiled material transporting device in FIG. 3.
Figure 7:
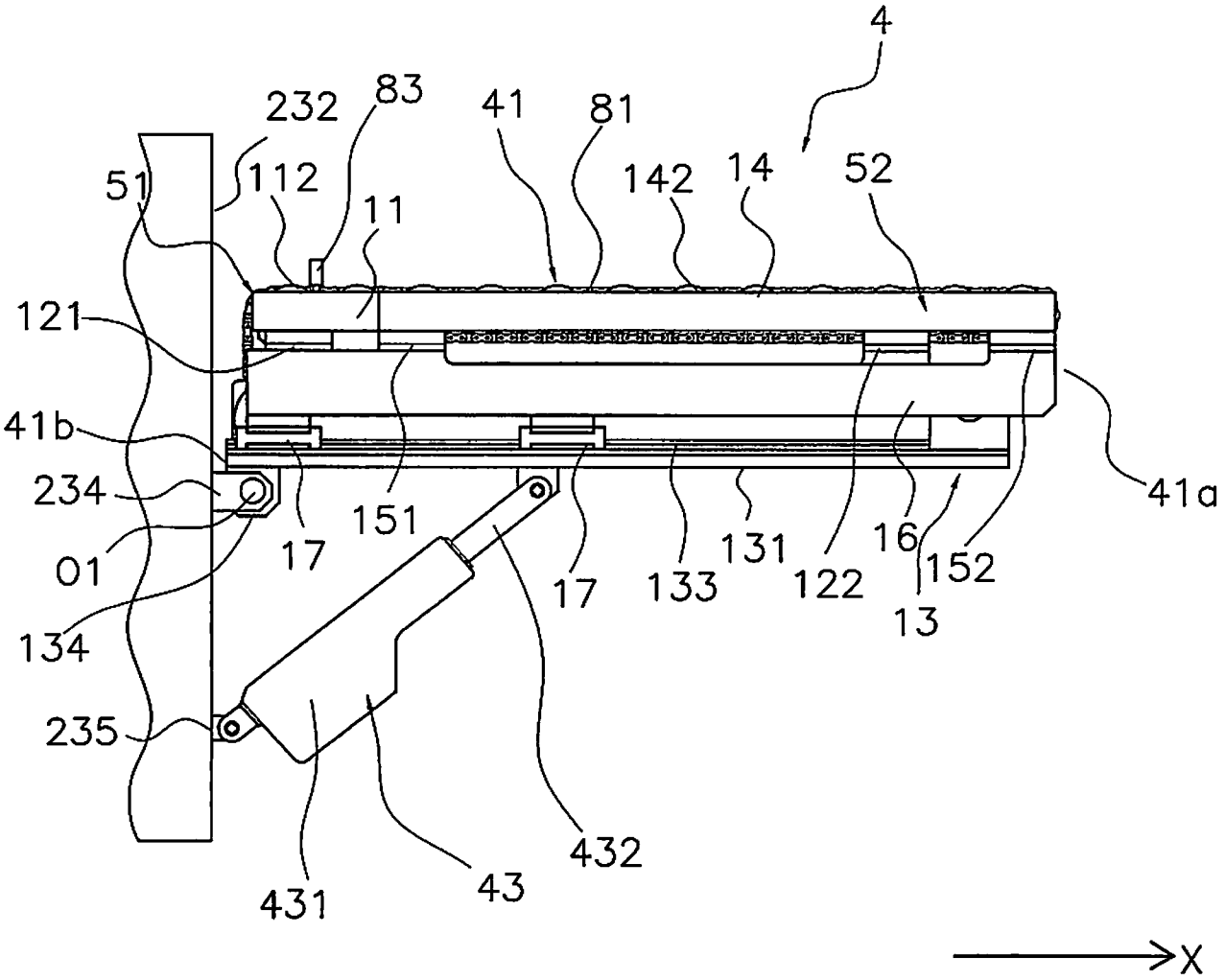
FIG. 7 is a side view of the state when the support of the coiled material transporting device in FIG. 6 is contracted.

FIG. 5 is an oblique view showing the state of the coiled material transporting device 4 when the support 41 is retracted. FIG. 6 is a side view showing the state of the coiled material transporting device 4 when the support 41 is extended. FIG. 7 is a side view showing the state of the coiled material transporting device 4 when the support 41 is retracted.

As shown in FIG. 3 and FIGS. 5 to 7, when the slide component 52 moves to the upstream side in the transport direction X, the upstream-side connection member 151 approaches the upstream-side connection member 121, the downstream-side connection member 152 approaches the downstream-side connection member 122, and the support 41 enters a retracted state. In a state in which the support 41 is retracted, the overlap between the second roller units 14 and the first roller units 11 is greater than in the state shown in FIG. 3 along the width direction Y.

FIG. 6 shows a state in which the support 41 is disposed in the supporting position.

1-4-3. Rotation Driver

As shown in FIG. 4, the rotation driver 43 is an electric cylinder and has a motor case 431 that houses an electric motor, and a rod 432 connected to a ball screw that is rotated by the electric motor. The rotation driver 43 is disposed in the center in the width direction Y in plan view. The electric motor provided to the rotation driver 43 can be a servo motor, a stepping motor, or the like, and is controlled by the transporting device controller 45.

A rotary support 131*a* that protrudes downward is provided to the lower face of the rotary plate-like part 131, and rotatably supports the distal end 432*a* of the rod 432. Although not depicted, the distal end 432*a* has a recess, and the rotary support 131*a* is disposed in this recess. The distal end 432*a* and the rotary support 131*a* are provided with a shaft and hole, etc., and the shaft is inserted into the hole to rotatably link the rod 432 to the rotary support 131*a*.

Also, a case linkage 431*a* is provided to the rear end of the motor case 431. Also, a rotary support 235 is provided to the housing 232 of the feeder 23. The case linkage 431*a* is rotatably supported by the rotary support 235, and is linked to the housing 232.

More precisely, the case linkage 431*a* has a pair of protrusions 431*b* provided at a specific spacing, and the rotary support 235 is disposed between the pair of protrusions 431*b*. A shaft and a hole, etc., are provided to the pair of protrusions 431*b* and the rotary support 235, and the motor case 431 is rotatably linked to the rotary support 235 at the case linkage 431*a*.

Figure 8:
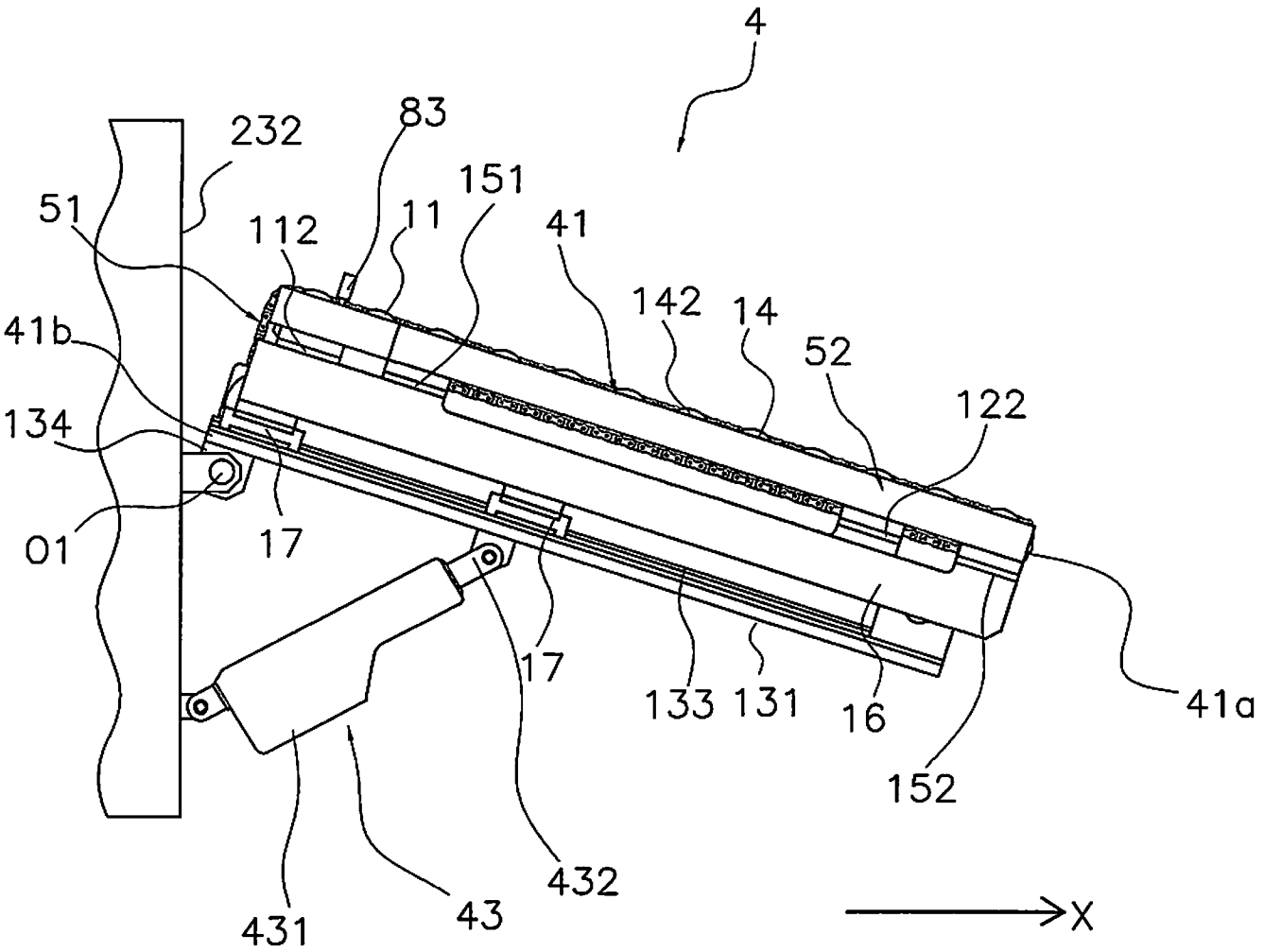
FIG. 8 is a side view of the state when the support of the coiled material transporting device in FIG. 7 has rotated downward.

FIG. 8 is a side view showing the coiled material transporting device 4 in a state in which the retracted support 41 has rotated downward. As shown in FIG. 8, when the electric motor in the motor case 431 is driven and the rod 432 moves in the direction of being pulled into the motor case 431, the end 41*a* of the support 41 on the press device main body 30 side rotates downward around the rotation fulcrums 134. The state shown in FIG. 8 is one in which the support 41 is disposed in the retracted position. The end 41*a* of the support 41 on the press device main body 30 side is, more precisely, the end of the slide component 52 out of the support 41.

1-4-4. Transporter

Figure 9:
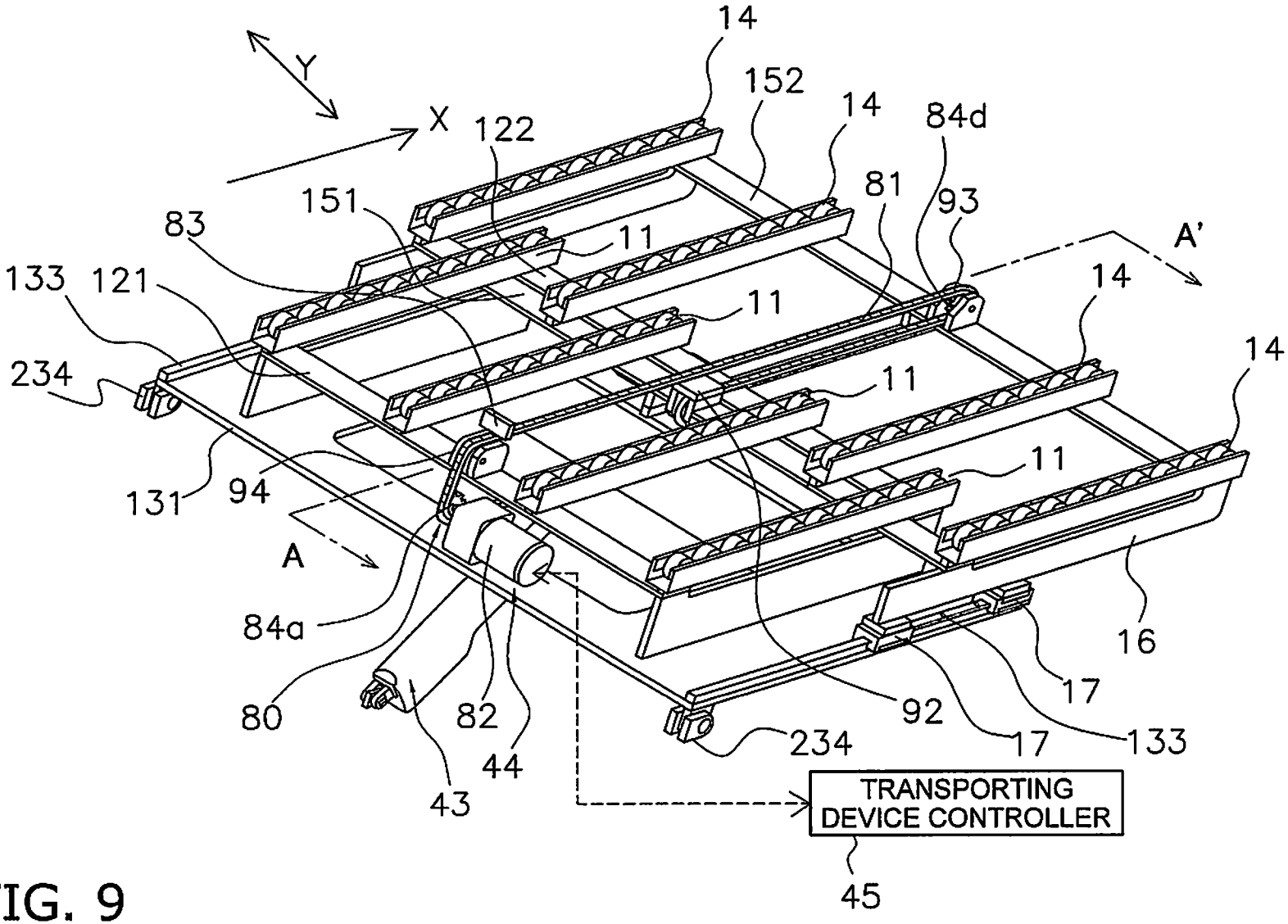
FIG. 9 is an oblique view as seen from the upstream side in the transport direction of the coiled material transporting device in FIG. 3.
Figure 10:
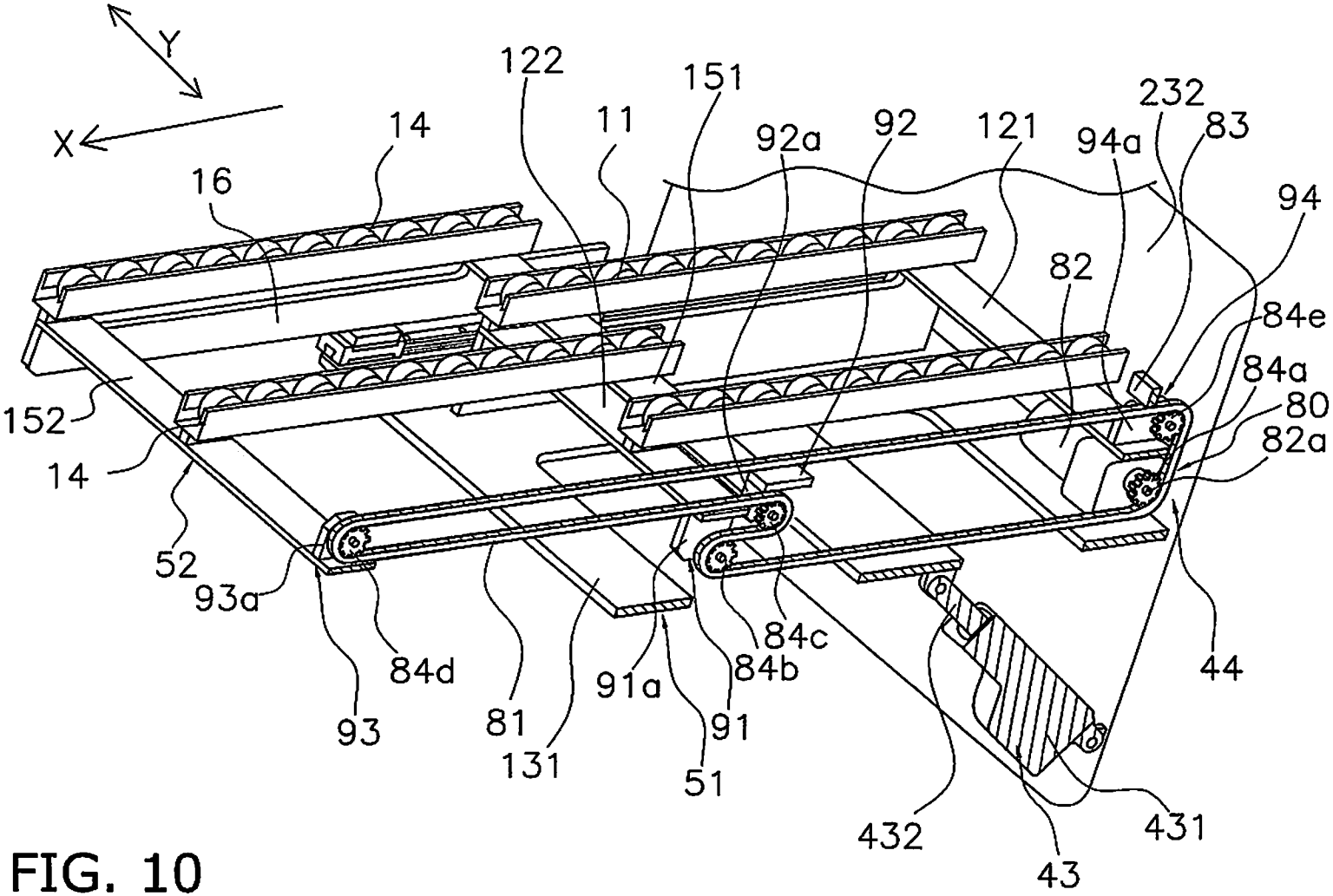
FIG. 10 is a cross section along the AA' line in FIG. 9.

FIG. 9 is an oblique view of the coiled material transporting device 4 from above the upstream side in the transport direction X. FIG. 10 is a cross section along the A-A' line.

As shown in FIGS. 9 and 10, the transporter 44 has a contact component 83 and a transport driver 80 for driving the contact component 83. The contact component 83 hits the terminal end 100*b* of the coiled material 100 (see FIG. 17). The transport driver 80 mainly has a chain 81, a chain drive motor 82, and a plurality of sprockets 84*a*, 84*b*, 84*c*, 84*d*, and 84*e*, and moves the contact component 83 in the transport direction X.

(a) Chain Drive Motor

The chain drive motor 82 is fixed near the center in the width direction Y at the upstream end in the transport direction X of the rotary plate-like part 131. As shown in FIG. 10, the chain drive motor 82 is disposed so that its rotary shaft 82*a* is parallel to the width direction Y. A servo motor or the like can be used as the chain drive motor 82, and the drive of the chain drive motor 82 is controlled by the transporting device controller 45.

(b) Sprockets

As shown in FIG. 10, the sprocket 84*a* is attached to the rotary shaft 82*a* of the chain drive motor 82. When the chain drive motor 82 is driven, the sprocket 84*a* rotates around the width direction Y.

The sprocket 84*b* is attached rotatably around the width direction Y in the center of the downstream-side connection member 122 of the rotation component 51. More precisely, a sprocket support 91 formed facing downward is provided in the center of the downstream-side connection member 122 of the rotation component 51. The sprocket support 91 is formed by a pair of support plates 91*a* that are opposite each other in the width direction Y, and the sprocket 84*b* is axially supported between the pair of support plates 91*a*.

The sprocket 84*c* is attached rotatably around the width direction Y in the center of the upstream-side connection member 151 of the slide component 52. More precisely, a sprocket support 92, which has an inverted U shape when viewed along the transport direction X, is formed in the center of the upstream-side connection member 151 of the slide component 52. The sprocket 84*c* is disposed on the inside of this inverted U-shaped sprocket support 92, and sprocket 84*c* is axially supported by the side walls 92*a* that are opposite each other in the width direction Y of an inverted U shape.

The sprocket 84*d* is mounted rotatably around the width direction Y in the center of the downstream-side connection member 152 of the slide component 52. More precisely, a sprocket support 93 formed facing upward is provided in the center of the downstream-side connection member 152 of the slide component 52. The sprocket support 93 is formed by a pair of support plates 93*a* that are opposite each other in the width direction Y, and the sprocket 84*d* is axially supported between the pair of support plates 93*a*.

The sprocket 84*e* is attached rotatably around the width direction Y in the center of the upstream-side connection member 121 of the rotation component 51. More precisely, a sprocket support 94 formed facing upward is provided in the center of the upstream-side connection member 121 of the rotation component 51. The sprocket support 94 is formed by a pair of support plates 94*a* that are opposite each other in the width direction Y, and the sprocket 84*e* is axially supported between the pair of support plates 94*a*.

When the support 41 is in a horizontal state, the sprocket 84*a* and the sprocket 84*b* are disposed at substantially the same height, and the sprocket 84*d* and the sprocket 84*e* are disposed at substantially the same height. The sprocket 84*c* is disposed at a height in between that of the sprockets 84*a* and 84*b* and that of the sprockets 84*d* and 84*e*.

(c) Chain

The chain 81 is an endless chain, is disposed in the center in the width direction Y of the support 41, and is wound around the above-mentioned sprocket 84*a* to 84*e*, in that order.

More precisely, the chain 81 is wound so as to reach from the upstream side of the sprocket 84*a* to the lower side, and is wound so as to go around the downstream side from the lower side of the sprocket 84*b* and reach the upper side. Then, the chain 81 is wound so as to go around the upstream side from the lower side of the sprocket 84*c* and reach the upper side, and is wound so as to go around the downstream side from the lower side of the sprocket 84*d* and reach the upper side. Then, the chain 81 is wound so as to reach the upstream side from the upper side of the sprocket 84*e*, and to face toward the sprocket 84*a*.

Figure 11:
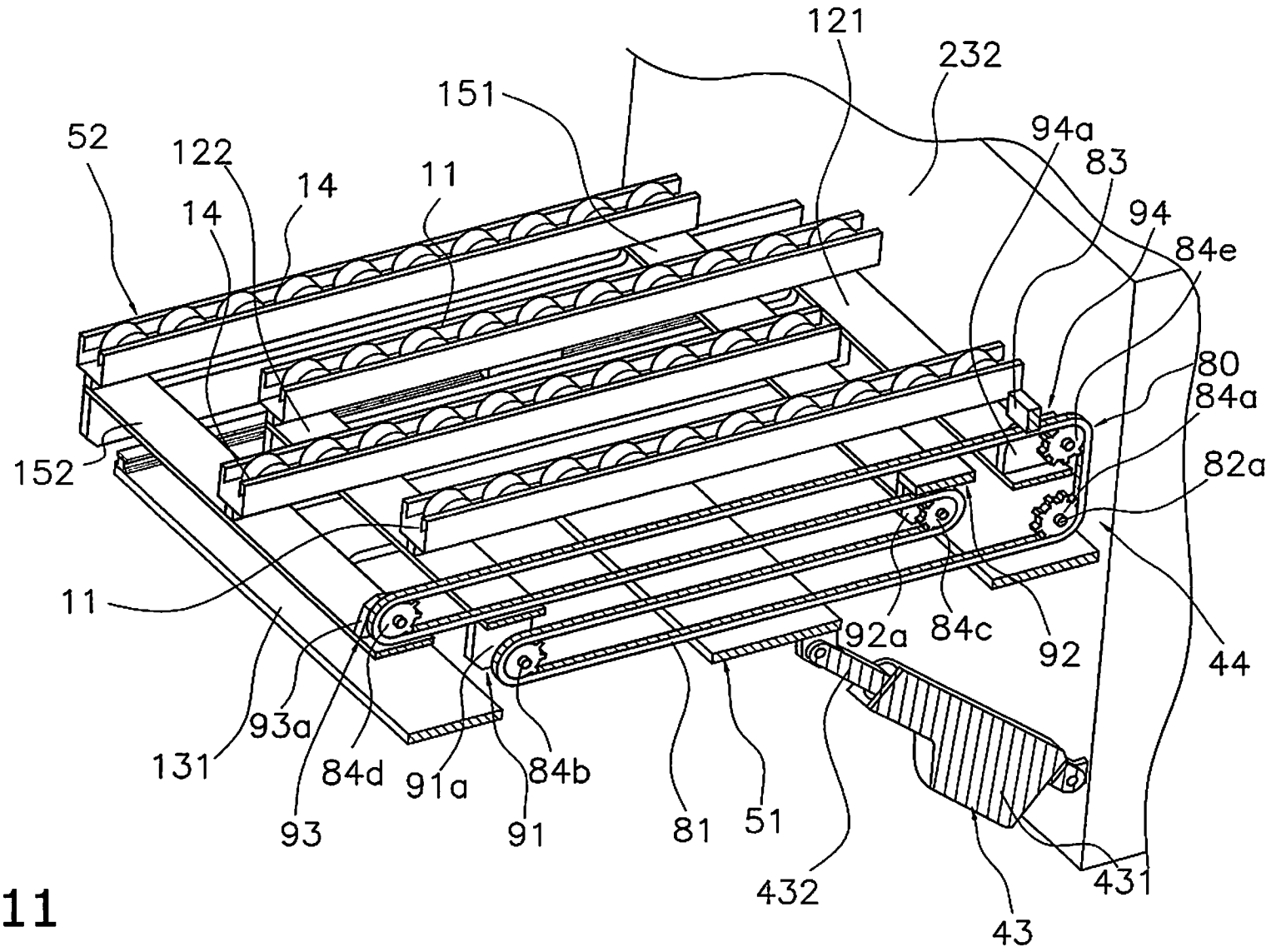
FIG. 11 is a cross section showing the state when the support of the coiled material transporting device in FIG. 10 is contracted.

FIG. 11 is a cross section showing the state when the support 41 in FIG. 10 has retracted.

As shown in FIGS. 10 and 11, even if the slide component 52 slides to the upstream side in the transport direction X, since the sprocket 84*c* and the sprocket 84*d* are attached to the slide component 52, tension can be maintained on the chain 81.

(d) Contact Component

The contact component 83 pushes the terminal end 100*b* of the coiled material 100 by hitting the terminal end 100*b* so as to transport the terminal end 100*b* toward the press device 3 side. The contact component 83 is a block-shaped member, and is fixed to the outside of the chain 81 as shown in FIGS. 9 to 11. The sprocket 84*a* is rotated by the drive of the chain drive motor 82, causing the chain 81 to rotate. The contact component 83 fixed to the chain 81 moves along the chain 81 as a result of the rotation of the chain 81.

In the above configuration, the coiled material transporting device 4 of this embodiment can change the position of the support 41 (including the orientation) by controlling the slide driver 42 and the rotation driver 43. Also, the contact component 83 can be moved by controlling the chain drive motor 82.

2. Operation

Next, the operation of the press system 1 of this embodiment will be described.

When a die 8 that is to be used for the first time is installed in the press device 3, the position of the support 41 in the press system 1 is set in advance so that the distal end 100*a* of the coiled material 100 supplied from the coiled material supply device 2 can be guided to the die 8.

2-1. Position Setting Operation

After the die 8 has been attached to the press device 3, the operator uses the control device 9 to send a command from the overall controller 5 to the supply device controller 24, causing the supply device controller 24 to drive the coiled material supply device main body 20.

The supply device controller 24 drives the uncoiler 21, the leveler 22, and the feeder 23 so that the distal end 100*a* of the coiled material 100 is played out from the discharge port 233 of the feeder 23 toward the press device 3 side.

Here, the operator sets the position of the support 41 by teaching, so that the distal end 100*a* of the coiled material 100 will be fed in between the guide members 72*a* and 72*b*.

Figure 12:
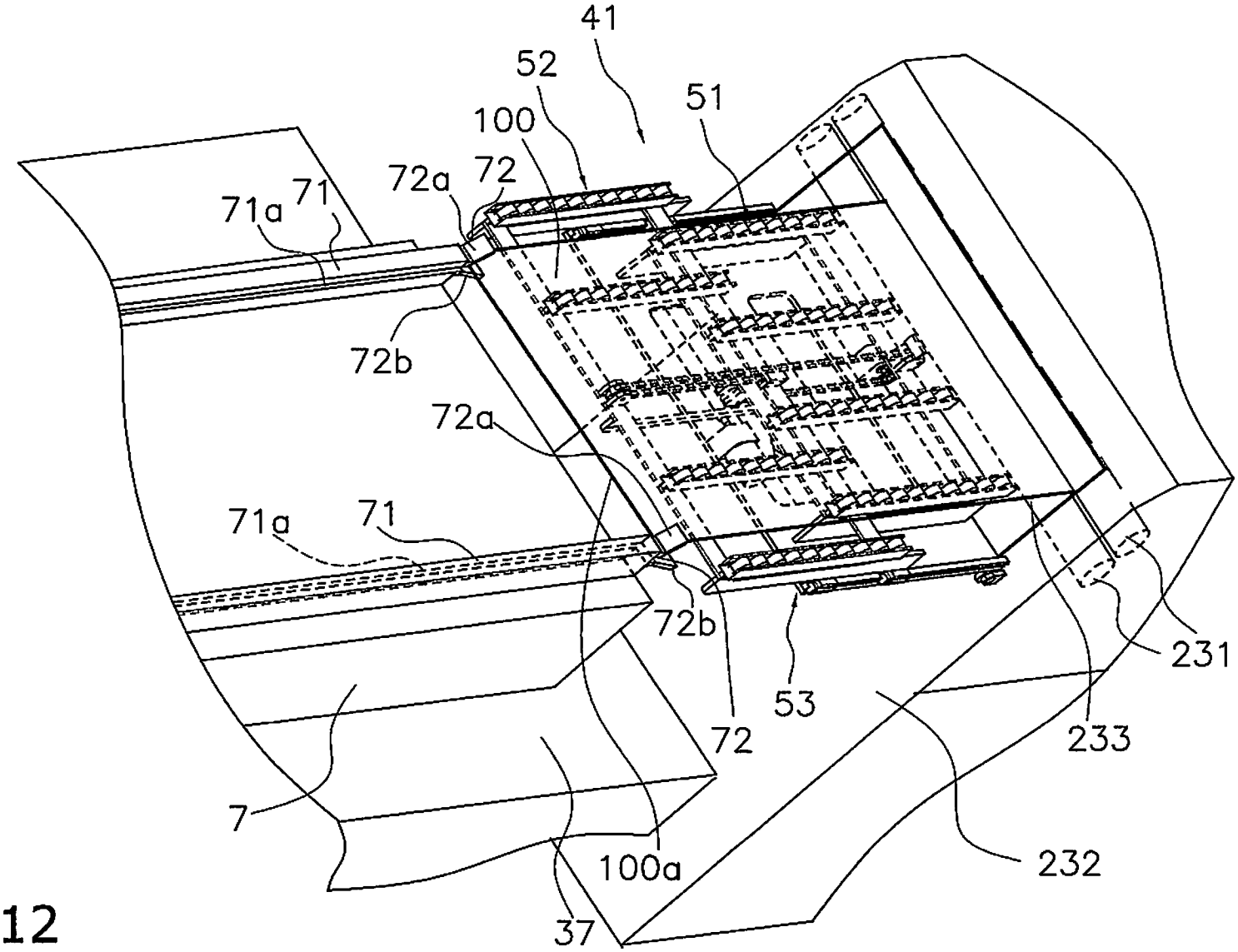
FIG. 12 is an oblique view of the state when the distal end of a coiled material is fed into a lower die.

More specifically, the electric motor 421 of the slide driver 42 and the electric motor of the rotation driver 43 are control to vary the rotational angle of the support 41 and the slide amount of the slide component 52, and while this is happening adjustment is performed as shown in FIG. 12 so that the distal end 100*a* of the coiled material 100 supplied from the coiled material supply device 2 is fed over the upper sides of the first roller units 11 and the second roller units 14 of the support 41 and fed into the end guides 72. FIG. 12 is a diagram showing the state when the distal end 100*a* of the coiled material 100 is guided by the support 41 and fed into the end guides 72.

The rotational angle and the slide amount by which the distal end 100*a* of the coiled material 100 is fed into the end guides 72 are found in this way. The rotational angle and the slide amount are stored, for example, in the position storage component 46, using the value of an encoder provided to the electric motor as position data.

Position data about the support 41 that thus allows the distal end 100*a* of the coiled material 100 to be guided to the end guides 72 is stored as the supporting position.

In order to provide versatility, the press device 3 generally allows a plurality of dies 8 of different shapes to be disposed. Since different dies 8 will have the different positions of the lifter guides 71, the position of the support 41 at which the distal end 100*a* of the coiled material 100 can be guided to the lifter guides 71 also varies.

Accordingly, with the coiled material transporting device 4 in this embodiment, the position of the support 41 is stored in the position storage component 46 for each die 8. In this specification, the word "position" also encompasses orientation, and control of the position of the support 41 also encompasses orientation control, such as the inclination of the support 41.

2-2. Pressing Operation

Figure 13:
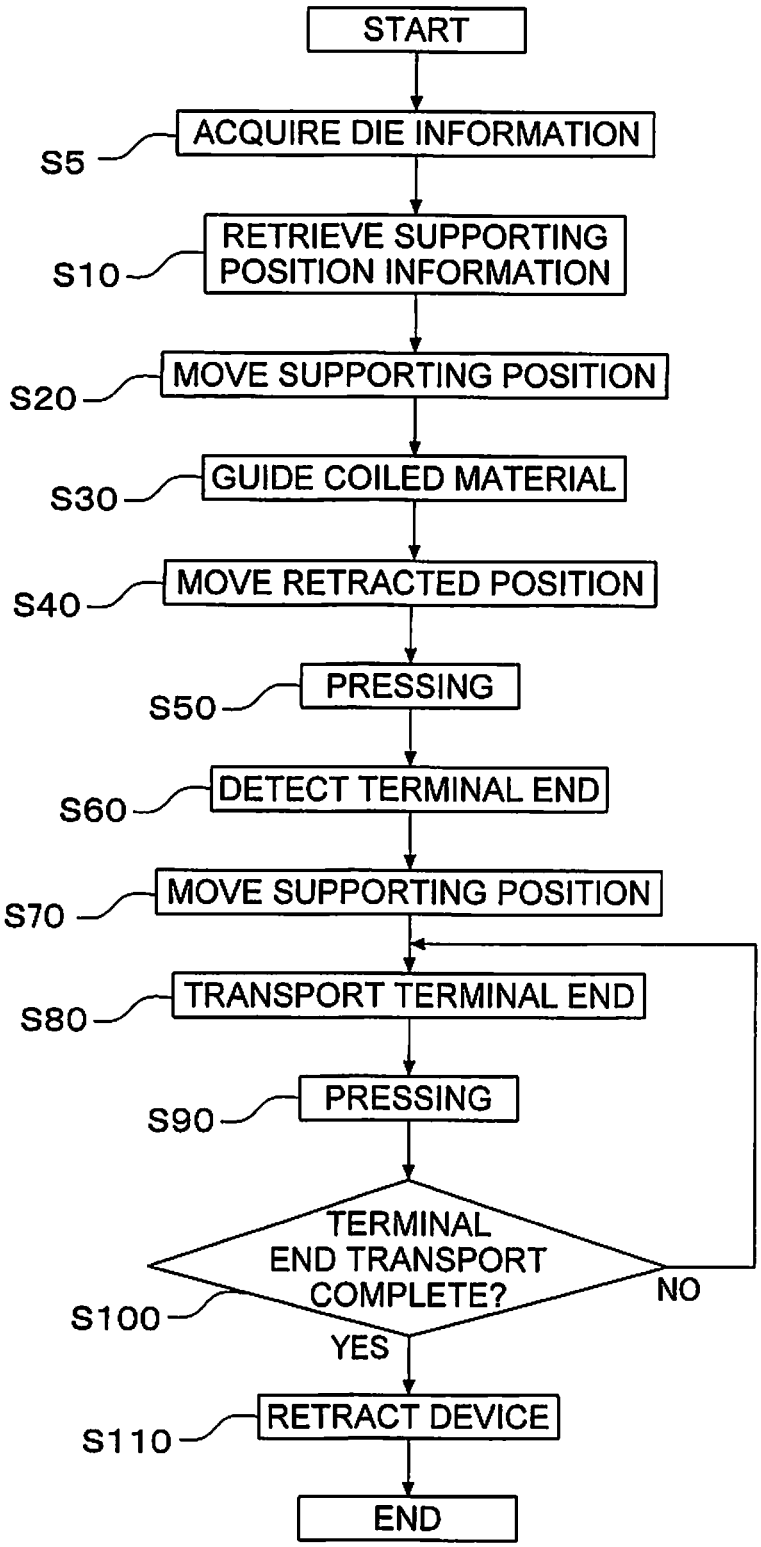
FIG. 13 is a flowchart illustrating the operation of the press system shown in FIG. 1.

Next, the pressing method in this embodiment will be described. FIG. 13 is a flowchart showing the pressing method in this embodiment.

When the die 8 and the coiled material 100 are replaced, the operator uses the control device 9, etc., so that the transporting device controller 45 recognizes the die 8 disposed in the press device 3, and information about the die 8 is acquired (step S5). Then, the transporting device controller 45 retrieves position data about the support 41 corresponding to that die 8 from the position storage component 46 (step S10).

Next, the transporting device controller 45 drives the slide driver 42 and the rotation driver 43, and control is performed so that the support 41 will be in the supporting position corresponding to the die 8 disposed in the press device 3 (step S20).

FIGS. 14A to 14C and FIGS. 15A to 15C are diagrams illustrating the operation of the coiled material transporting device 4.

Figure 14A:
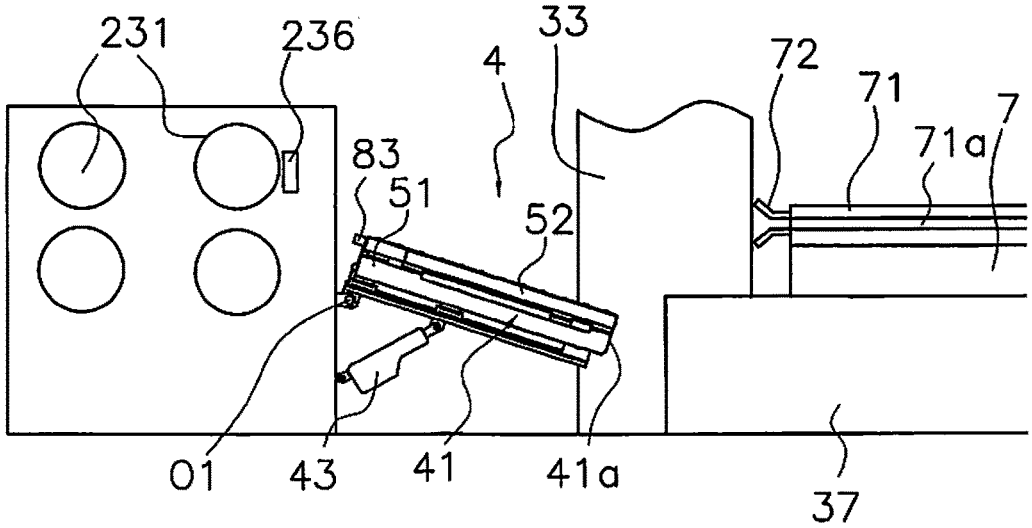
FIGS. 14A to 14C are diagrams illustrating the operation in which the distal end of the coiled material is guided to the lower die by the coiled material transporting device in FIG. 3.

First, as shown in FIG. 14A, the coiled material transporting device 4 enters a state in which the slide component 52 is drawn to the rotation component 51 side, and the rotation component 51 has been rotated downward. That is, this is a state in which the support 41 is retracted and the end 41*a* of the support 41 has been lowered around the rotational axis O1. This position of the support 41 is the retracted position.

Figure 14B:
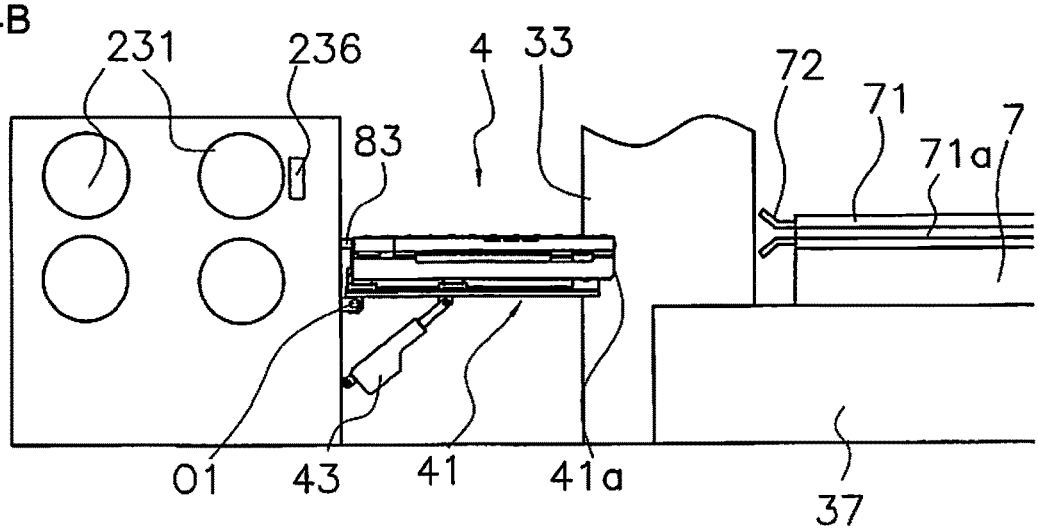

As shown in FIG. 14B, the transporting device controller 45 then drives the rotation driver 43 until the value taken from the position storage component 46 is reached, causing the support 41 to rotate so that the end 41*a* moves upward.

Figure 14C:
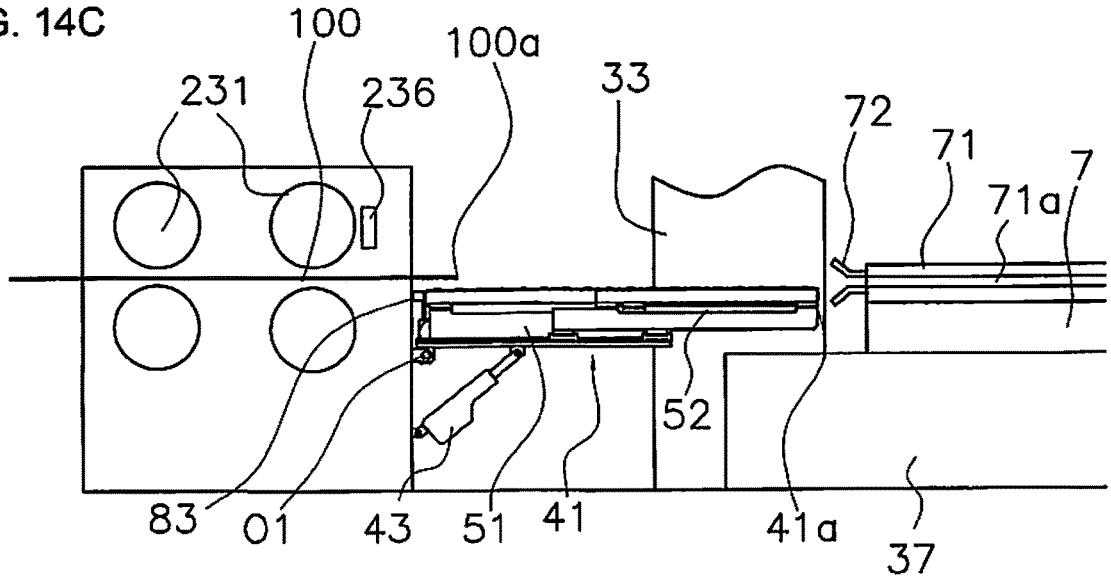

Next, as shown in FIG. 14C, the transporting device controller 45 drives the electric motor 421 of the slide driver 42 until the value retrieved from the position storage component 46 is reached, and as a result the slide component 52 is slid toward the die 8 with respect to the rotation component 51.

Consequently, the end 41*a* on the press device 3 side of the support 41 is positioned near the end guides 72 of the lower die 7, and movement of the support 41 to the supporting position is concluded. As shown in FIG. 14C, the contact component 83 of the transporter 44 is not disposed between the sprocket 84*d* and the sprocket 84*e* (the upper side of the support 41), and is instead disposed between the sprocket 84*a* and the sprocket 84*e* (the upstream side of the support 41). Also, at the supporting position shown in FIG. 14C, the support 41 is disposed substantially horizontally, but depending on the type of lower die 7, the end 41*a* may be located higher or lower than in FIG. 14C, with the support 41 inclined.

Next, in step S30, the overall controller 5 sends a command to the supply device controller 24, the supply device controller 24 controls the coiled material supply device main body 20, and the coiled material 100 is uncoiled while being fed from the discharge port 233 of the feeder 23 into the coiled material transporting device 4.

Figure 15A:
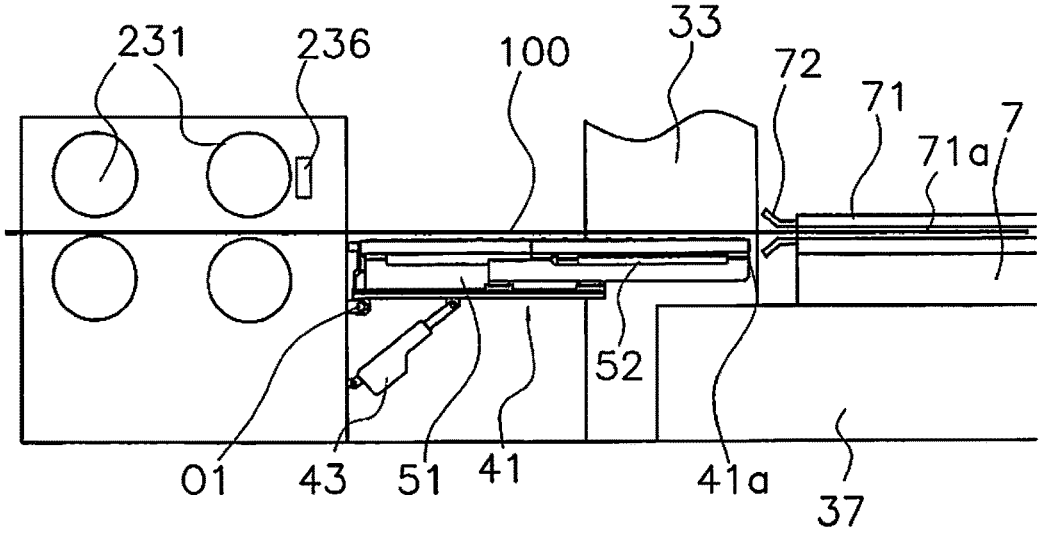
FIGS. 15A to 15C are diagrams illustrating the operation in which the distal end of the coiled material is guided to the lower die by the coiled material transporting device in FIG. 3.

The distal end 100*a* of the coiled material 100 supplied from the coiled material supply device 2 goes over the first roller units 11 and the second roller units 14 while being fed into the end guides 72, as shown in FIG. 15A. Since the rollers 112 and 142 of the first roller units 11 and the second roller units 14 shown in FIG. 3 rotate along with the movement of the coiled material 100, the coiled material 100 is fed smoothly to the lifter guides 71.

Here, after the replacement of the coiled material 100 and replacement of the die 8, in order to confirm whether the pressing was performed properly, the operator uses the control device 9 to advance the coiled material 100 so that it moves through the die 8 one process at a time (drilling, drawing, bending, etc.).

Figure 15B:
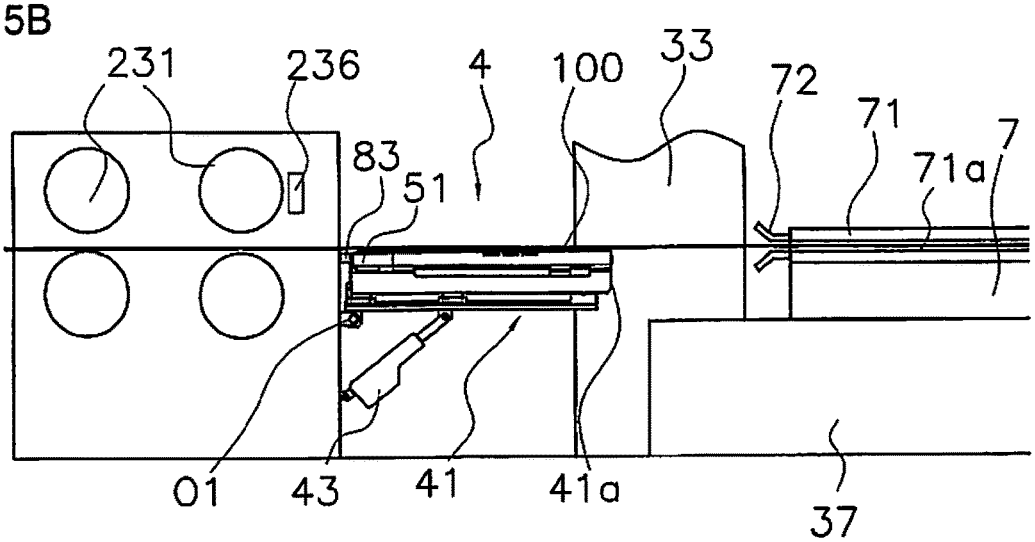

When the operator uses the control device 9 to start a pressing operation, before the pressing operation is begun, the transporting device controller 45 moves the support 41 to the retracted position in step S40. More specifically, as shown in FIG. 15B, the transporting device controller 45 controls the electric motor 421 of the slide driver 42, retracts the support 41, and pulls in the slide component 52 from the inside of the press device main body 30.

Figure 15C:
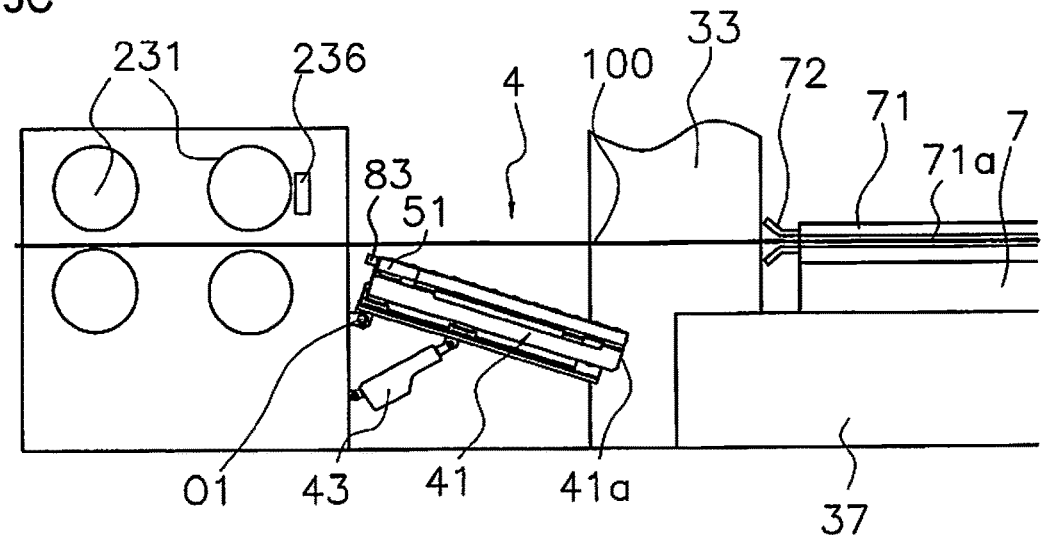

Next, the transporting device controller 45 rotates the rotation component 51 downward as shown in FIG. 15C by driving the electric motor (not shown) of the rotation driver 43. This moves the support 41 to the retracted position.

Next, in step S50, the overall controller 5 sends a command to the press device controller 38, and the press device controller 38 drives the pressing driver 36 to move the slide 35 up or down. Consequently, the coiled material 100 that was guided into the press device 3 is subjected to pressing.

Figure 16B:
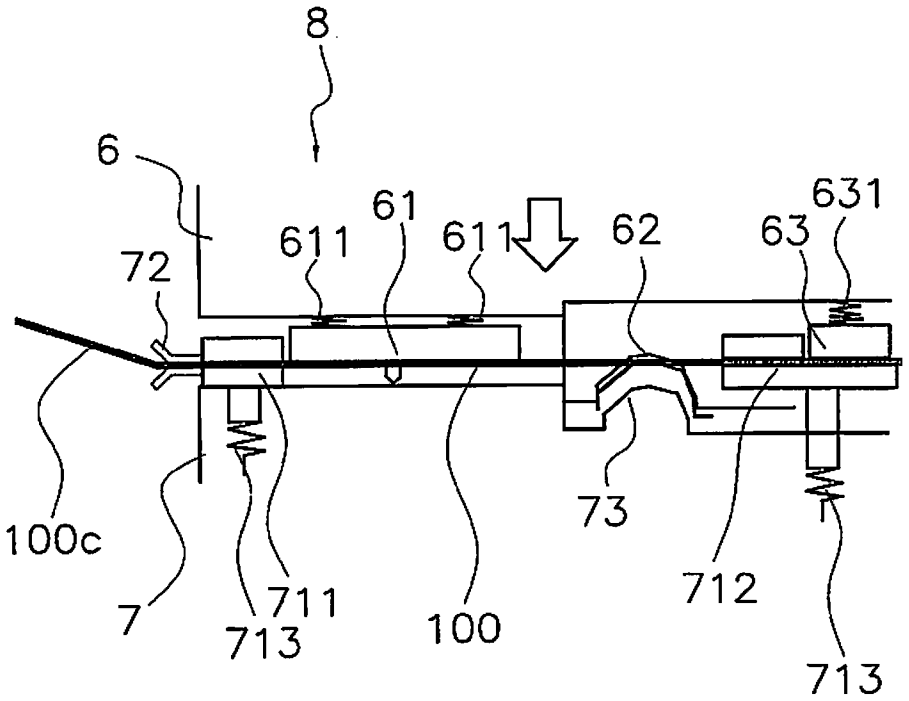
FIGS. 16A and 16B are diagrams illustrating the movement of the coiled material during pressing with the press device shown in FIG. 1.
Figure 16A:
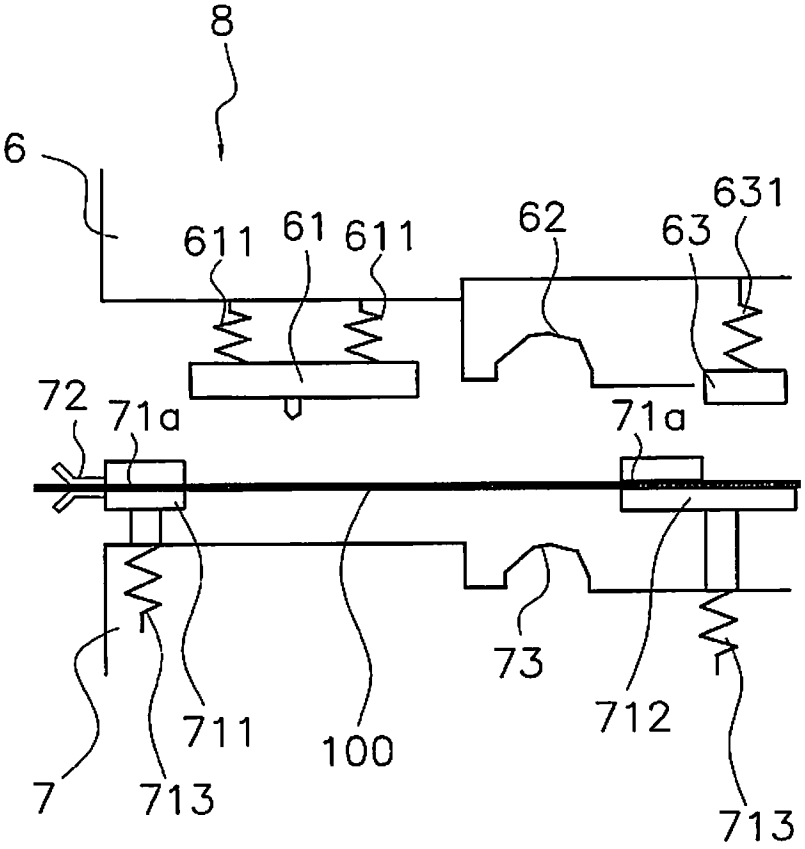

FIGS. 16A and 16B are simplified diagrams illustrating the up and down movement of the coiled material 100 during pressing. The upper die 6 and the lower die 7 are shown in FIGS. 16A and 16B. The die 8 shown in FIG. 16A has a portion where drilling will be performed and a portion where bending will be performed after drilling. To describe the configuration of the die 8 shown in FIG. 16A sequentially, at the lower die 7, the lifter guides 71 are split up, and in the drawings are depicted as 711 and 712. Spring members 713 are provided on the lower sides of the lifter guides 711 and 712, and bias the lifter guides 711 and 712 upward. A hole punch 61 is formed on the downstream side of the lifter guide 711 on the upper die 6. Spring members 611 are provided on the upper side of the hole punch 61. A bender 62 is formed on the downstream side of the hole punch 61 on the upper die 6. Also, a hold-down 63 is provided on the downstream side of the bender 62, and a spring member 631 is provided on the upper side of the hold-down 63.

A bender 73 is formed on the lower die 7 opposite the bender 62 of the upper die 6. The lifter guide 712 is provided on the downstream side of the bender 73.

When the press device controller 38 lowers the slide 35, as shown in FIGS. 16A and 16B, the upper die 6 is lowered, the coiled material 100 is sandwiched between the upper die 6 and the lower die 7, and pressing is performed. During pressing, as shown in FIG. 16B, since the lifter guides 711 and 712 move downward, the coiled material 100 also moves downward. Therefore, the portion of the coiled material 100 that is closer to the coiled material supply device 2 side than the lower die 7 (shown as 100*c* in the drawings) is pulled downward. To prevent the coiled material 100 from being subjected to excessive tension during pressing as a result of this pulling, with the coiled material transporting device 4 in this embodiment, the support 41 is moved to the retracted position (see FIG. 15C) after the distal end 100*a* of the coiled material 100 has been guided to the lifter guides 71 (711 and 712).

With the coiled material supply device 2, the rollers 231 separate from the coiled material 100 at the same time as the lowering of the slide 35, which prevents the coiled material 100 from being subjected to excessive tension.

Thereafter, the coiled material is sequentially supplied from the coiled material supply device 2, and pressing is performed by the press device 3.

Figure 17A:
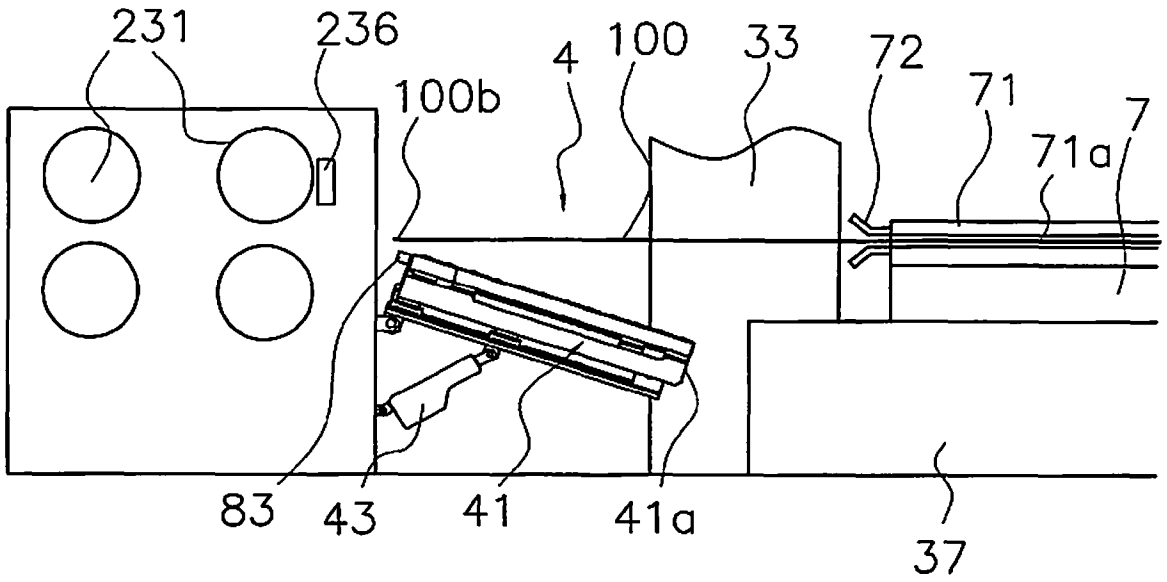
FIGS. 17A and 17B are diagrams illustrating the operation in which the terminal end of the coiled material is guided to the lower die by the coiled material transporting device in FIG. 3.

Pressing is then carried out sequentially, and as shown in FIG. 17A, the terminal end detector 236 detects that the coiled material 100 has run out and its terminal end 100*b* has passed the rollers 231 of the feeder 23 (step S60), whereupon the supply device controller 24 transmits the detection result to the overall controller 5.

Figure 17B:
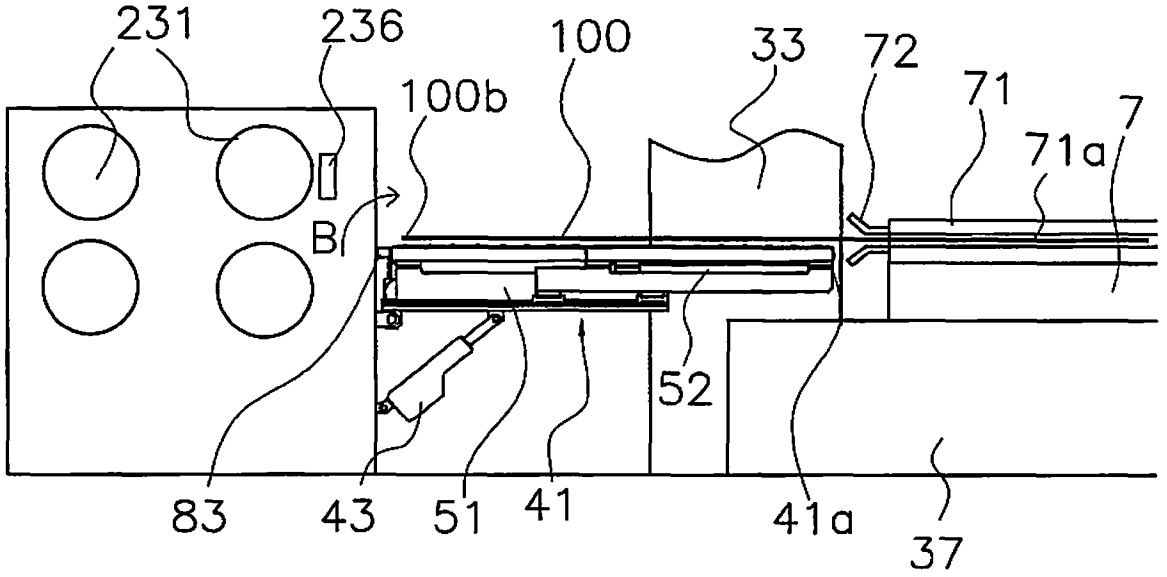

The overall controller 5 stops the press device 3 and sends a command to the transporting device controller 45, and the transporting device controller 45 moves the support 41 from the retracted position to the supporting position as shown in FIG. 17B (step S70).

Figure 18A:
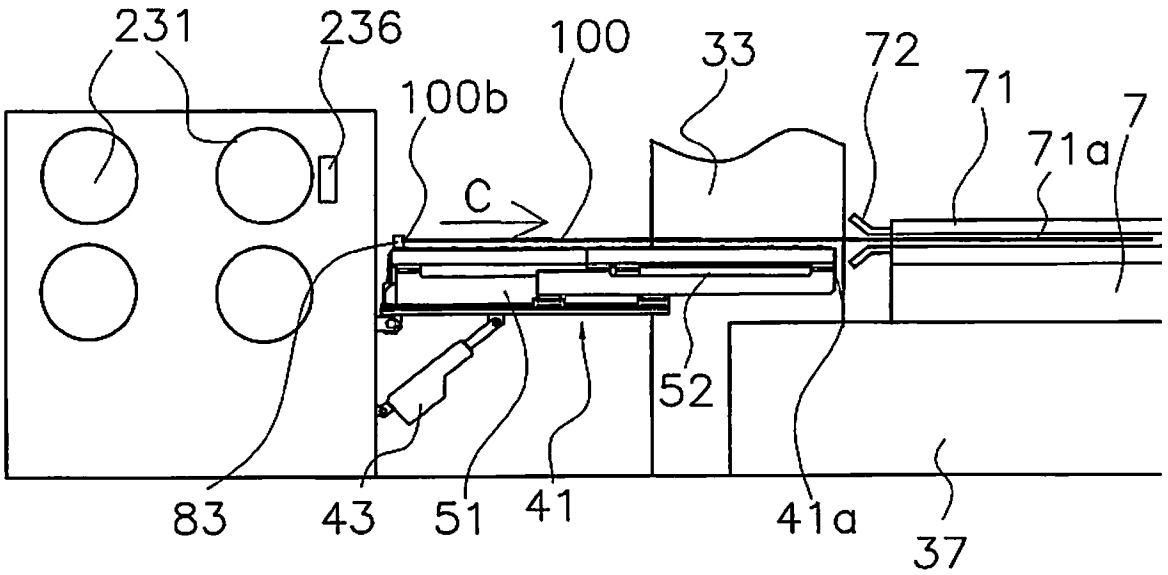
FIGS. 18A and 18B are diagrams illustrating the operation in which the terminal end of the coiled material is guided to the lower die by the coiled material transporting device in FIG. 3.

As indicated by the arrow B in FIG. 17B, the transporting device controller 45 then drives the chain drive motor 82 to rotate the chain 81. The rotation of the chain 81 causes the contact component 83 to move toward the downstream side while passing the upper side of the support 41, and to hit the terminal end 100*b* as shown in FIG. 18A. When the contact component 83 moves further to the downstream side (see the arrow C), the terminal end 100*b* is pushed toward the lower die 7, and the coiled material 100 is transported toward the lower die 7 (step S80).

The overall controller 5 performs pressing by actuating the press device 3 to match the transport of the coiled material 100 by the contact component 83 (step S90).

Figure 18B:
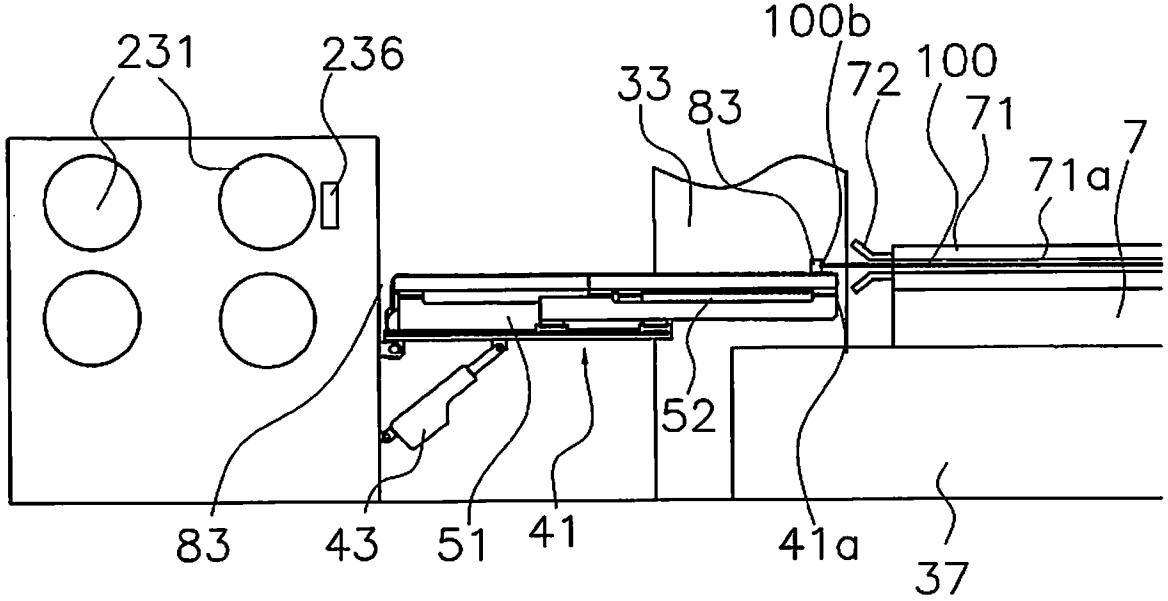

As shown in FIG. 18B, steps S80 and S90 are repeated until the contact component 83 moves to the end 41*a* on the press device side of the support 41 (step S100). When the contact component 83 reaches the end 41*a* of the support 41, the transporting device controller 45 moves the support 41 from the supporting position to the retracted position (step S110), and control comes to an end. The arrival of the contact component 83 at the end 41*a* of the support 41 can be detected by the encoder of the chain drive motor 82.

It is also possible to move the support 41 to the retracted position in the pressing performed in step S90.

3. Features (3-1)

As shown in FIGS. 2 and 3, the coiled material transporting device 4 in this embodiment is a coiled material transporting device that is disposed between the coiled material supply device 2 for supplying the coiled material 100 and the press device 3 for pressing the coiled material 100 supplied from the coiled material supply device 2, and comprises the support 41, the slide driver 42 (an example of a first driver), and the transporter 44. The support 41 can be extended and retracted in the direction of the die 8 disposed in the press device 3, and supports from below the terminal end 100*b* of the coiled material 100 supplied from the coiled material supply device 2. The slide driver 42 extends and retracts the support 41. The transporter 44 is provided to the support 41 and transports the terminal end 100*b* of the coiled material 100 toward the die 8 disposed in the press device 3.

Thus, the transporter 44 that transports the terminal end 100*b* of the coiled material 100 is provided to the support 41 that supports the terminal end 100*b* of the coiled material 100 from below. Accordingly, there is no need to provide a mechanism for transporting the terminal end 100*b* of the coiled material 100 above the support 41, and the support 41 can be extended to the inside of the press device 3 by the slide driver 42 and disposed closer to the die 8.

The terminal end 100*b* of the coiled material 100 can then be fed into the die 8 (more precisely, the lower die 7) by transporting the terminal end 100*b* of the coiled material 100 with the transporter 44.

Since the support 41 can thus be disposed closer to the die 8, waste of the coiled material 100 can be kept to a minimum and the material can be utilized more effectively.

(3-2)

As shown in FIG. 4, the coiled material transporting device 4 in this embodiment further comprises the transporting device controller 45 (an example of a controller). The transporting device controller 45 controls the slide driver 42 (an example of a first driver) so that the end 41*a* (an example of a first end) of the support 41 on the press device 3 side will be disposed in a position corresponding to the die 8 (more precisely, the lower die 7) disposed in the press device 3 when the terminal end 100*b* of the coiled material 100 is transported to the die 8 disposed in the press device 3.

Since the user will use dies 8 of various sizes and shapes, it is common to use a bolster 37 whose size matches the size of the largest die to be used. Accordingly, when a small die 8 is used, for example, the die 8 is disposed at a position that is more to the inside than the outer edge of the bolster 37, so material ends up being wasted with a conventional device.

However, if the position of the end 41*a* of the support 41 on the press device 3 side is set to match the die 8, even when the die 8 is disposed so that it goes into the interior of the bolster 37, the support 41 can be extended to match the die 8. Therefore, the amount of wasted material can be reduced, and the material can be utilized more effectively.

(3-3)

The coiled material transporting device 4 in this embodiment further comprises the rotation driver 43 (an example of a second driver). The rotation driver 43 moves the end 41*a* of the support 41 on the press device 3 side in the up and down direction. The transporting device controller 45 (an example of a controller) controls the rotation driver 43 so that the position of the end 41*a* (an example of a first end)

of the support 41 in the up and down direction will be a position corresponding to the die 8 disposed in the press device 3.

The end 41*a* of the support 41 can be matched to the height of the die 8 disposed in the press device 3 by controlling the vertical position of the end 41*a* of the support 41 on the press device 3 side. This allows the terminal end 100*b* of the coiled material 100 to be moved by the transporter 44 to match dies 8 of various heights.

(3-4)

With the coiled material transporting device 4 in this embodiment, the support 41 is able to move between a supporting position at which the terminal end 100*b* of the coiled material 100 is supported from below and a retracted position at which the support is retracted from the supporting position. The transporting device controller 45 (an example of a controller) controls the slide driver 42 (an example of a first driver) and the rotation driver 43 (an example of a second driver) to move the support 41 between the supporting position and the retracted position.

The coiled material 100 that has been guided to the die 8 disposed in the press device 3 is disposed in the lifter guides 71 of the die 8, and during pressing, the coiled material 100 moves downward along with the sinking of the lifter guides 71. Therefore, in a state in which the support 41 is in the supporting position during pressing, the pressing of the coiled material 100 may be affected.

However, in this embodiment, since the support 41 is able to move between the retracted position and the supporting position, the coiled material 100 can be prevented from being affected during pressing by moving the support 41 to the retracted position during pressing, taking the terminal end 100*b* of the coiled material 100 out of the feeder 23 (an example of a feeder) and then moving the support 41 to the supporting position, and then transporting the terminal end 100*b*.

(3-5)

The coiled material transporting device 4 in this embodiment further comprises the position storage component 46 (an example of a storage component). The position storage component 46 stores a supporting position for each die 8 that will be disposed in the press device 3. The transporting device controller 45 (an example of a controller) controls the slide driver 42 (an example of a first driver) and the rotation driver 43 (an example of a second driver) and thereby disposes the support 41 in the supporting position corresponding to the die 8 that is disposed in the press device 3.

The position of the support 41 is decided for each die 8 in advance by teaching or the like, and these positions are stored in the position storage component 46, which allows the support 41 to be moved automatically to the supporting position corresponding to the die 8 disposed in the press device 3.

This allows the support 41 to be positioned in the appropriate supporting position for each die 8.

This teaching should be performed during test pressing with the dies 8.

(3-6)

With the coiled material transporting device 4 in this embodiment, as shown in FIG. 4, the end 41*b* (an example of a second end) of the support 41 on the opposite side from the end 41*a* (an example of a first end) is rotatably supported by the coiled material supply device 2. The rotation driver 43 (an example of a second driver) rotates the support 41 so that the end 41*a* moves in the up and down direction around the end 41*b* side.

Consequently, the support 41 can be rotated and the end 41*a* on the press device 3 side can be positioned near the die 8 disposed in the press device 3.

(3-7)

With the coiled material transporting device 4 in this embodiment, the transporter 44 has the contact component 83 and the transport driver 80 (an example of a third driver). The contact component 83 hits the terminal end 100*b* of the coiled material 100. The transport driver 80 moves the contact component 83 in the transport direction X.

Consequently, the contact component 83 pushes the terminal end 100*b* of the coiled material 100 in the transport direction X, and the terminal end 100*b* of the coiled material 100 is transported to the die 8 disposed in the press device 3.

(3-8)

With the coiled material transporting device 4 in this embodiment, the transport driver 80 (an example of a third driver) has the chain 81 (an example of a belt-like member) and the chain drive motor 82 (an example of a drive motor). The chain 81 is rotatably supported along the transport direction X by the support 41, and the contact component 83 is fixed. The chain drive motor 82 (an example of a drive motor) rotates the chain 81.

Consequently, the rotation of the chain 81 moves the contact component 83 in the transport direction X.

(3-9)

With the coiled material transporting device 4 in this embodiment, the chain 81 (an example of a belt-like member) is disposed in the center of the support 41 in the width direction Y that is perpendicular to the transport direction X.

Consequently, the contact component 83 moves along the center in the width direction Y toward the transport direction X, allowing the terminal end 100*b* of the coiled material 100 to be transported regardless of the width of the coiled material 100.

(3-10)

With the coiled material transporting device 4 in this embodiment, the support 41 has the rotation component 51 and the slide component 52. The rotation component 51 has the end 41*b* (an example of a second end). The slide component 52 can slide in the transport direction X with respect to the rotation component 51. The slide driver 42 (an example of a first driver) extends and retracts the supporting portion 41 by sliding the slide component 52 with respect to the rotation component 51. The rotation component 51 has a plurality of the first roller units 11 (an example of a first support portion) having a plurality of the rollers 112 (an example of a sliding member) disposed along the transport direction X for allowing the coiled material 100 to slide. The slide component 52 has a plurality of the second roller units 14 (an example of a second support portion) having a plurality of the rollers 142 (an example of a sliding member) disposed along the transport direction X for allowing the coiled material 100 to slide. The first roller units 11 and the second roller units 14 are disposed alternately from the center in the width direction Y of the support 41 perpendicular to the transport direction X (more precisely, from the chain 81) toward the two ends in the width direction Y.

Thus, because the support 41 is configured to be able to slide by means of the rollers 11 and 14, a space can be formed in the center, making it easier to dispose the chain 81.

(3-11)

With the coiled material transporting device 4 in this embodiment, the transporting device controller 45 (an example of a controller) controls the slide driver 42 (an example of a first driver) so that when the distal end 100*a* of the coiled material 100 is supplied from the coiled material supply device 2 to the press device 3, the end 41*a* (an example of a first end) of the support 41 on the press device 3 side will be disposed at a position corresponding to the die 8 disposed in the press device 3.

Consequently, not only can the terminal end 100*b* of the coiled material 100 be transported toward the press device 3, but the distal end 100*a* of the coiled material 100 supplied from the coiled material supply device 2 can also be guided to the press device 3.

Thus, guidance of the distal end 100*a* of the coiled material 100 can be performed automatically, so there is no need for the operator to handle the transfer of the distal end 100*a* of the coiled material 100 from the coiled material supply device 2 to the die 8 disposed in the press device 3, nor is it necessary for the operator to move into the press device 3 every time the coiled material 100 or the die 8 is replaced, which means that it takes less time to performed setup during replacement.

(3-12)

The press system 1 in this embodiment comprises the coiled material supply device main body 20, the press device main body 30, the coiled material transporting device main body 40, the supply device controller 24, the press device controller 38, and the transporting device controller 45. The coiled material supply device main body 20 supplies the coiled material 100. The press device main body 30 performs pressing of the coiled material 100 supplied from the coiled material supply device main body 20. The coiled material transporting device main body 40 is disposed between the coiled material supply device main body 20 and the press device main body 30. The supply device controller 24 controls the coiled material supply device main body 20. The press device controller 38 controls the press device main body 30. The transporting device controller 45 controls the coiled material transporting device main body 40. The coiled material transporting device main body 40 has the support 41, the slide driver 42 (an example of a first driver), and the transporter 44. The support 41 supports from below the terminal end 100*b* of the coiled material 100 supplied from the coiled material transporting device main body 20. The slide driver 42 extends and retracts the support 41, and extends the support 41 when the terminal end 100*b* of the coiled material 100 is transported to the die 8. The transporter 44 is provided to the support 41 and transports the terminal end 100*b* of the coiled material 100 toward the die 8 disposed in the press device 3. The supply device controller 24 controls the slide driver 42 (an example of a first driver) so that when the terminal end 100*b* of the coiled material 100 is transported to the die 8 disposed in the press device 3 (more precisely, to the lower die 7), the end 41*a* (an example of a first end) of the support 41 on the press device 3 side will be disposed at a position corresponding to the die 8 disposed in the press device main body 30.

Consequently, the support 41 can extend to the inside of the press device main body 30 and can be disposed near the die 8, and the transporter 44 can transport the terminal end 100*b* of the coiled material 100, so the terminal end 100*b* of the coiled material 100 can be fed to near the die 8. Accordingly, waste of the coiled material 100 can be kept to a minimum, and the material can be used more effectively.

(3-13)

The coiled material transporting method in this embodiment comprises a step S5 (an example of a die information acquisition step), a step S10 (an example of a position data acquisition step), a step S70 (an example of a driving step), and a step S80 (an example of a transport step). Step S5 (an example of a die information acquisition step) involves acquiring die information about the die 8 installed in the press device 3. Step S10 (an example of a position data acquisition step) involves acquiring position data about the end 41*a* (an example of the die-side distal end) of the support 41 that supports the distal end 100*a* of the coiled material 100 from below and guides it to the die 8, on the basis of die information. Step S70 (an example of a driving step) involves driving the support 41 on the basis of the position data. Step S80 (an example of a transport step) involves transporting the terminal end 100*b* of the coiled material 100 toward the die 8 disposed in the press device 3.

This allows the terminal end 100*b* of the coiled material 100 to be transported to the die 8. Therefore, waste of the coiled material 100 can be kept to a minimum, and the material can be utilized more effectively.

Other Embodiments (A)

In the above embodiment, the coiled material transporting device 4 is supported by the coiled material supply device 2, but may instead be provided between the uprights 33 of the press device 3.

(B)

In the above embodiment, the transporting device controller 45 of the coiled material transporting device 4 is provided to the controller 9 along with the supply device controller 24 of the coiled material supply device 2 and the press device controller 38 of the press device 3, but the transporting device controller 45 may be provided by itself. For example, the coiled material transporting device 4 may be provided with a control device having a CPU, a memory, a display, an interface unit, etc., and the transporting device controller 45 may be provided inside this control device.

Also, if the press device 3 and the coiled material supply device 2 each have a control device, and the press device controller 38 is provided to the control device of the press device 3, and the supply device controller 24 is provided to the control device of the coiled material supply device 2, then the transporting device controller 45 may be provided to either of these control devices.

(C)

In the above embodiment, the transporter 44 performs transport by pushing the terminal end 100*b* of the coiled material with the contact component 83, but a magnet may be mounted on the chain 81, for example, and the terminal end 100*b* of the coiled material 100 may be transported by magnetic force.

Also, instead of providing the transporter 44, the support 41 may be given a transporting function by driving the rollers 112 and 142 of the first roller units 11 and the second roller units 14. In this case, the transporter can also be said to serve as the support 41.

(D)

In the above embodiment, the chain 81 is used as an example of the belt-shaped member to which the contact component 83 is fixed, but this is not the only option, and a belt-like member made of rubber or the like may be used instead, for example.

(E)

In the above embodiment, the transport driver 80, which is an example of a third driver, has the chain 81 (an example of a belt-like member) and the chain drive motor 82 (an example of a drive motor), but is not limited to this configuration, that is, any configuration in which the contact component 83 is moved in the transport direction X may be employed. For example, the third driver may have a device for linear movement, such as a cylinder or a linear motor, and the contact component 83 may be moved by these in the transport direction X.

(F)

In the above embodiment, an electric cylinder is used as the rotation driver 43, but a hydraulic cylinder may be used instead.

(G)

In the above embodiment, the electric motor 421 is provided to the slide driver 42, and a mechanism consisting of the rack 423 and the pinion 422 allows the slide component 52 to slide with respect to the rotation component 51, but this is not the only option. For example, an electric cylinder may be fixed to the rotation component 51 and the distal end of the rod thereof linked to the slide component 52, thereby allowing the slide component 52 to slide with respect to the rotation component 51. This electric cylinder may be a hydraulic cylinder.

(H)

With the coiled material transporting device 4 in the above embodiment, just one transporter 44 is provided in the center in the width direction Y, but a plurality of rows may be provided, and not necessarily in the center.

(I)

With the coiled material transporting device 4 in the above embodiment, the rollers 112 and 142 are provided as an example of a sliding member, but this is not the only option, and free ball bearings, a skid bar, or the like may be used instead, for example. In other words, the sliding member may be any member that allows the coiled material 100 to slide.

INDUSTRIAL APPLICABILITY

The coiled material transporting device and the coiled material transporting method of the present invention are useful in a sequential feed type of press system or etc. because they have the effect of allowing the material to be used more effectively.

The invention claimed is:

1. A coiled material transporting device disposed between a coiled material supply device supplying a coiled material, and a press device pressing the coiled material supplied from the coiled material supply device, the coiled material transporting device comprising:

a support extendable and retractable along a direction of a die disposed in the press device, the support being configured to support from below a terminal end of the coiled material supplied from the coiled material supply device;

a first driver configured to cause the support to extend and retract;

a transporter provided to the support and configured to transport the terminal end of the coiled material toward the die disposed in the press device;

a controller configured to control the first driver so that when the terminal end of the coiled material is transported to the die disposed in the press device, a first end on a press device side of the support is disposed at a position corresponding to the die disposed in the press device; and a second driver configured to move the first end on the press device side of the support along an up and down direction, the controller being further configured to control the second driver so that the first end of the support along the up and down direction is disposed at a position corresponding to the die disposed in the press device.

2. The coiled material transporting device according to claim 1, wherein the support is movable between a supporting position at which the support supports the terminal end of the coiled material from below, and a retracted position at which the support is retracted from the supporting position, and the controller is further configured to control the first driver and the second driver so that the support is moved between the supporting position and the retracted position.

3. The coiled material transporting device according to claim 2, further comprising a storage component configured to store the support position for each die disposed in the press device, the controller being further configured to control the first driver and the second driver so that the support is disposed in the supporting position corresponding to the die disposed in the press device.

4. The coiled material transporting device according to claim 1, wherein a second end of the support on an opposite side from the first end is rotatably supported by the coiled material supply device, and the second driver is configured to rotate the support so that the first end moves in the up and down direction around the second end.

5. The coiled material transporting device according to claim 1, wherein the transporter includes a contact component configured to come into contact with the terminal end of the coiled material, and a third driver configured to move the contact component along a transport direction of the coiled material moving from the coiled material supply device to the press device.

6. The coiled material transporting device according to claim 5, wherein the third driver includes a belt-shaped member supported by the support rotatably along the transport direction, and to which the contact component is fixed, and a drive motor configured to rotate the belt-shaped member.

7. The coiled material transporting device according to claim 6, wherein the belt-shaped member is disposed in a center of the support along a width direction perpendicular to the transport direction.

8. The coiled material transporting device according to claim 4, wherein the support includes a rotation component having the second end, and a slider having the first end and is able to slide along a transport direction with respect to the rotation component, the first driver extends and retracts the support by sliding the slider with respect to the rotation component, the rotation component has a plurality of first support portions having a plurality of sliding members that are disposed along the transport direction and that allow the coiled material to slide, the slider has a plurality of second support portions having a plurality of sliding members that are disposed along the transport direction and that allow the coiled material to slide, and the first support portions and the second support portions are disposed alternately from a center along a width direction of the support that is perpendicular to the transport direction, toward the ends in the width direction.

9. The coiled material transporting device according to claim 1, wherein the controller is further configured to control the first driver so that when the distal end of the coiled material is supplied from the coiled material supply device to the press device, the first end on the press device side of the support is disposed in a position corresponding to the die disposed in the press device.

10. A press system, comprising:

a coiled material supply device main body configured to supply a coiled material;

a press device main body configured to perform pressing of the coiled material supplied from the coiled material supply device main body;

a coiled material transporting device main body disposed between the press device main body and the coiled material supply device main body;

a supply device controller configured to control the coiled material supply device main body;

a press device controller configured to control the press device main body; and a transporting device controller configured to control the coiled material transporting device main body, the coiled material transporting device main body including a support extendable and retractable along a direction of a die disposed in the press device main body, the support being configured to support from below a terminal end of the coiled material supplied from the coiled material supply device main body, a first driver configured to cause the support to extend and retract, and a transporter provided to the support and configured to transport the terminal end of the coiled material toward the die disposed in the press device main body, and the transporting device controller being configured to control the first driver so that when the terminal end of the coiled material is transported to the die disposed in the press device main body, a first end on the press device main body side of the support is disposed at a position corresponding to the die disposed in the press device main body, a second driver configured to move the first end on the press device main body side of the support along an up and down direction, the controller being further configured to control the second driver so that the first end of the support along the up and down direction is disposed at a position corresponding to the die disposed in the press device main body.

11. A coiled material transporting method, comprising:

acquiring die information about a die disposed in a press device;

acquiring position data about a die-side distal end of a support that supports a distal end of the coiled material from below and guides the distal end to the die, based on the die information;

driving the support based on the position data; and transporting a terminal end of the coiled material toward the die disposed in the press device.

* * * * *